US009845599B2

(12) United States Patent
Bogh et al.

(10) Patent No.: US 9,845,599 B2
(45) Date of Patent: Dec. 19, 2017

(54) STRUCTURAL STEEL DECKING SYSTEM AND METHOD OF SECURING

(71) Applicant: Nucor Corporation, Charlotte, NC (US)

(72) Inventors: Brian Hansen Bogh, Yucaipa, CA (US); Christopher Lawrence Brown, Whittier, CA (US); Jeffrey Reino Martin, Fremont, CA (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 14/689,109

(22) Filed: Apr. 17, 2015

(65) Prior Publication Data

US 2015/0308116 A1 Oct. 29, 2015

Related U.S. Application Data

(60) Provisional application No. 61/983,277, filed on Apr. 23, 2014.

(51) Int. Cl.
*E04C 2/32* (2006.01)
*E04B 5/32* (2006.01)
(Continued)

(52) U.S. Cl.
CPC ..... *E04C 2/322* (2013.01); *E04B 5/32* (2013.01); *E04C 2/08* (2013.01); *E04B 2103/06* (2013.01)

(58) Field of Classification Search
CPC ... E04C 2/08; E04C 2/322; E04B 5/32; E04B 2103/06
(Continued)

(56) References Cited

U.S. PATENT DOCUMENTS 107,290 A 9/1870 Reynolds
182,183 A 9/1876 Ervien
(Continued)

FOREIGN PATENT DOCUMENTS

AU WO 2004106661 A1 * 12/2004 ..... E04B 5/40
CN 202053595 U 11/2011
(Continued)

OTHER PUBLICATIONS

International Search Report and Written Opinion for International Application No. PCT/US16/32402 dated Sep. 1, 2016.

*Primary Examiner* — Charles A Fox
*Assistant Examiner* — Joseph J Sadlon
(74) *Attorney, Agent, or Firm* — Moore & Van Allen PLLC; Jeffrey R. Gray

(57) ABSTRACT

Embodiments of the invention included structural decking systems with at least a four-layered seam and methods for manufacturing and assembling structural decking systems with at least four-layered seams. The decking panels may be provided with an edge having an exposed "male lip" with two layers, and an opposite edge having a "female lip" with two layers. Individual panels may be coupled together by placing the female lip of a first panel over the male lip of an adjacent panel, thus creating an unjoined seam. In order to couple the panels together, the panels may be secured through various couplings configurations. The couplings may be formed by deforming, cutting, and/or welding the seam. Not only do the couplings help prevent vertical separation between adjacent panels, the couplings minimize lateral shifting along the seam, and ensure a desired level of shear strength in the seam and across the structural decking system.

6 Claims, 26 Drawing Sheets

(51) Int. Cl.
*E04C 2/08* (2006.01)
*E04B 1/38* (2006.01)

(58) Field of Classification Search
USPC ..... 52/579, 630, 745.05
See application file for complete search history.

(56) References Cited

U.S. PATENT DOCUMENTS 182,193 A 9/1876 Holeton
326,557 A 9/1885 Hayes
345,687 A 7/1886 Hayes
426,627 A 4/1890 Sagendorph
824,551 A 6/1906 Levis
938,869 A 11/1909 Hunter
968,887 A 8/1910 Roth
993,686 A 5/1911 Howard
1,292,960 A * 1/1919 Owens ..... E04D 3/364 296/29
1,743,209 A 1/1930 Groehn
2,254,558 A 9/1941 Williams
2,602,408 A 7/1952 Smith-Johannsen
2,619,855 A 12/1952 Williams
2,626,687 A 1/1953 Williams
2,668,890 A 2/1954 Latour
2,829,714 A 4/1958 Kalb
2,874,666 A 2/1959 Thor
2,924,312 A 2/1960 Williams
2,964,829 A 12/1960 Spengler et al.
3,010,199 A 11/1961 Smith et al.
3,110,079 A 11/1963 Wilson et al.
3,163,931 A 1/1965 Nielsen
3,213,583 A 10/1965 Winski
3,312,028 A 4/1967 Schroyer
3,399,503 A * 9/1968 Dyer ..... B32B 27/00 52/406.1
3,411,339 A 11/1968 Brown
3,465,414 A 9/1969 Koett
3,474,585 A 10/1969 Foster
3,535,843 A 10/1970 Hughes
3,538,660 A * 11/1970 Moor ..... B28B 7/06 52/220.7
3,606,718 A 9/1971 Curran
3,624,876 A 12/1971 Irvin
3,641,729 A 2/1972 Irvin
3,714,688 A 2/1973 Olson
3,726,000 A 4/1973 Hafner
3,728,779 A 4/1973 Behlen et al.
3,877,280 A 4/1975 Cornell
3,889,437 A 6/1975 Day et al.
3,924,378 A 12/1975 Hafner
3,982,373 A 9/1976 Wilson et al.
4,035,901 A 7/1977 Lux et al.
D256,843 S 9/1980 Madsen
4,224,775 A * 9/1980 Heckelsberg ..... 52/528
4,233,795 A 11/1980 Snyder et al.
4,353,240 A 10/1982 Undin et al.
4,392,295 A 7/1983 Sasai et al.
4,442,581 A 4/1984 Molnick
4,459,735 A 7/1984 Sawdon
4,505,084 A * 3/1985 Knudson ..... B21D 13/04 52/519
4,525,976 A 7/1985 Simpson
4,527,544 A * 7/1985 Wolf ..... A01G 9/222 126/605
4,531,397 A 7/1985 Pratt
4,558,584 A 12/1985 Myers
4,571,975 A 2/1986 Pawloski et al.
4,575,983 A 3/1986 Lott, Jr. et al.
4,759,165 A 7/1988 Getoor et al.
4,860,514 A 8/1989 Kelly
4,870,798 A * 10/1989 Richter ..... E04D 3/364 52/528
4,893,493 A 1/1990 Jacques et al.
4,962,622 A * 10/1990 Albrecht ..... E04B 5/40 52/220.4
4,986,691 A 1/1991 Hafner
4,987,716 A 1/1991 Boyd
4,989,438 A 2/1991 Simon
RE33,563 E 4/1991 Heckelsberg
RE33,566 E * 4/1991 Heckelsberg ..... E04D 3/30 52/520
5,187,911 A 2/1993 Cotter
5,221,183 A 6/1993 Hoeffken
5,247,772 A * 9/1993 Greenberg ..... E04D 3/363 52/528
5,337,535 A 8/1994 Maupin
5,381,686 A 1/1995 Thorup
5,509,291 A 4/1996 Nilsson et al.
5,600,971 A 2/1997 Suk
5,651,221 A * 7/1997 Golen ..... E06B 9/02 49/464
5,697,197 A * 12/1997 Simpson ..... 52/462
5,715,639 A * 2/1998 Yamada ..... E04D 3/363 52/469
5,855,101 A * 1/1999 Schulte ..... E04D 3/3608 52/506.05
5,860,265 A 1/1999 Knudson et al.
5,878,617 A 3/1999 Parker
5,884,405 A 3/1999 Breeden
5,976,292 A 11/1999 Barksdale et al.
6,070,449 A 6/2000 Vachon
6,076,320 A 6/2000 Butler
6,212,932 B1 * 4/2001 Parker ..... 72/409.12
6,250,036 B1 6/2001 Nurley et al.
6,314,699 B1 * 11/2001 West ..... E04B 5/023 52/177
6,397,469 B2 6/2002 Parker
6,527,335 B1 3/2003 Yurgevich
6,689,449 B2 2/2004 Hasan et al.
6,889,478 B1 * 5/2005 Simpson ..... E04C 3/08 52/520
6,904,730 B2 6/2005 Mitchell
7,021,023 B2 * 4/2006 Rood, Jr. ..... E04D 3/364 52/588.1
7,104,020 B1 9/2006 Suttle
7,162,788 B2 1/2007 Inch et al.
7,353,584 B2 4/2008 DeFreese et al.
7,434,314 B2 * 10/2008 Morton ..... 29/897.31
7,634,882 B1 * 12/2009 Briggs ..... E04D 3/364 52/489.1
7,891,308 B2 * 2/2011 Bianchi ..... B63B 3/06 114/79 W
7,963,083 B1 * 6/2011 Briggs ..... E04D 3/364 52/489.1
7,984,596 B1 7/2011 Simpson et al.
8,104,156 B2 * 1/2012 Morton ..... B21D 39/021 29/243.5
8,141,221 B2 * 3/2012 Webb ..... B32B 3/28 29/428
8,171,689 B2 5/2012 Pierson et al.
8,322,014 B1 12/2012 Rider
2001/0039704 A1 * 11/2001 Parker ..... B21D 39/03 29/33 R
2013/0074434 A1 * 3/2013 Wiens ..... 52/528
2015/0322686 A1 * 11/2015 Harper ..... E04H 9/10 52/481.1

FOREIGN PATENT DOCUMENTS

CN 202108134 U 1/2012
DE 2423226 A1 11/1975
GB 2397074 A * 7/2004 ..... E04B 5/40
JP 57165550 A 10/1982
KR 200476203 Y1 2/2015
WO WO 2006125248 A1 * 11/2006

* cited by examiner

SECTION A-A

SECTION B-B

STRUCTURAL STEEL DECKING SYSTEM AND METHOD OF SECURING

CLAIM OF PRIORITY UNDER 35 U.S.C. §119

The present application for a patent claims priority to U.S. Provisional Patent Application Ser. No. 61/983,277 entitled "Structural Steel Decking System and Method of Securing" filed on Apr. 23, 2014 and assigned to the assignees hereof and hereby expressly incorporated by reference herein.

FIELD

This application relates generally to the field of structural decking systems, and more particularly to improvements to structural decking systems due to an improved seam created between adjacent decking panels.

BACKGROUND

Structural decking is used in commercial or industrial construction (and in some cases residential construction), for example, as a component of poured concrete floors or as structural roofing (e.g., for commercial buildings, industrial buildings, institutional buildings, or the like). The structural decking may be typically manufactured from steel sheets. To create the structural strength and the stiffness of the steel sheets, decking panels with longitudinal profiles are formed from the steel sheets via roll forming, break forming, bending, stamping, or other like processes. The decking panels are secured to each other in order to form the structural steel decking system when installed.

The panels are also connected to the other load resisting structural members of a building, such as beams, joists, walls, or the like. When the panels are connected to each other in a secure manner, the assembled structural steel decking system provides considerable diaphragm (or membrane) strength, which is used to transfer vertical and lateral loads to the vertical and lateral load carrying components of the building. In geographical regions that are prone to seismic activity (e.g., earthquakes) and/or high winds, the panels of structural steel decking are solidly connected to each other and to the other load resisting structural members of the building, so that the building is better able to withstand horizontal shear forces created by the seismic activity and/or high winds. The panels are connected to reduce, or eliminate excessive, vertical separation or lateral movement between adjacent structural steel decking panels. To this end, the seam between adjacent panels of structural steel decking is joined in such a way as to create lateral resistance in a direction parallel to the lengthwise extending axis of the seam to thereby carry loads (e.g., resist forces) and prevent displacement between the deck panels. In addition, the connection of the panels at the seam also creates vertical resistance in a direction perpendicular to the lengthwise extending axis of the seam in order to carry loads (e.g., construction loads) and to maintain the structural integrity of the diaphragm strength of the system.

BRIEF SUMMARY

Structural steel decking panels may be provided with two edges: one edge having an exposed "male lip" (e.g., upwardly extending male lip), and an opposite edge having a "female lip" in the shape of a "U" (e.g., inverted U or V shape, or another like shaped channel with the opening extending downwardly). Individual panels may be coupled together by placing the female lip of a first panel over the male lip of an adjacent panel, thus creating an unjoined side-lap seam along the length of the panel edges. In the present invention, the seam created by placing the female lip over the male, is a four-layer seam. In some embodiments of the invention, the male lip has two-layers and the female lip also has two-layers. The male lip may have a first male layer extending in a generally upright configuration and a second male layer folded (e.g., inwardly or outwardly) back towards the first male layer in an open or closed configuration. The female lip may also have a first female layer extending in a generally upright configuration and a second female layer folded outwardly back towards the first female layer in an open configuration. As such, the two-layer female lip may create a channel in which the two-layer male lip may be inserted in order to form the four-layer seam. In other embodiments of the invention other types of seams having different configurations of the layers or more than four layers may be utilized in the present invention, which are described in further detail below throughout this specification.

In order to couple (e.g., secure, join, or the like) the panels together along the seam to prevent or reduce the movement of one panel lifting off of the other or moving laterally with respect to each other, the panels may be secured through various couplings configurations. The couplings described herein may also be described generally as joints, connections, attachments, or the like. One example of a coupling in the present invention may be a weld, such as a top seam weld (otherwise referred to as a top arc seam weld), in which the top of the female lip (e.g., inverted "U" shaped female lip, or other like shaped lip with a channel) and the top of the male lip are welded together to form the coupling. In other embodiments, a side seam weld may be used in which the welds are created through the sides of the female lip and the male lip. Alternatively, the couplings may be formed by deforming at least a portion of the female lip over at least a portion of the male lip and/or forming a dimple in the seam (e.g., for example crimping the seam and forming a non-piercing button punch). The coupling may also be formed by cutting a portion of the seam, such as punching a hole through the seam, shearing the seam, or the like to create the coupling. One or more of these types of joints may be used to form the coupling, for example, deforming the seam and cutting a portion of the seam may both occur (e.g., in any order) in order to create the coupling. As such, the couplings may be formed by deforming, dimpling (e.g., a non-piercing button punch), and/or cutting (e.g., piercing punch, shearing, or the like) the seam (e.g., in any order). In one example, shearing and deforming of a portion of the seam may create a louver that results in a tab that provides interference at the ends of the tab to resist lateral movement of the adjacent panels. In still other embodiments of the invention, the couplings may be formed through the use of bolts and screws, rivets, or other like mechanical fastener.

The couplings formed in the seam may be located at predetermined optimal intervals along the length of the seam to join the decking panels and prevent or reduce movement between them. Not only do the couplings help prevent or reduce vertical separation between adjacent panels, the couplings prevent or minimize lateral shifting along the seam, and ensure a desired level of shear strength and/or stiffness in the seam and across the structural decking system.

The four-layer seam, illustrated in some embodiments of the present invention, results in improved shear strength along the length of the seam. As such, because of the improved shear strength in the four layer seam, thinner material thicknesses may be used for the decking panels and/or not as many couplings are needed to create a decking system that has a shear strength that is the same as or similar to the shear strength of a decking system that utilizes a three-layer, two-layer, or other like seam. As such, using decking systems with four-layer seams or seams with greater than four-layers, results in decking systems that cost less due to reduced material costs (e.g., reduced price for thinner steel decking panels) and/or due to reduced assembly costs (e.g., assembly time is reduced due to fewer couplings).

One embodiment of the invention comprises a structural decking system. The structural decking system comprising a first decking panel comprising first top flanges, first bottom flanges, first webs, and at least one edge comprising a male lip. The structural decking system further comprises a second decking panel comprising second top flanges, second bottom flanges, second webs, and at least one edge comprising a female lip. The female lip of the second decking panel is placed over the male lip of the first decking panel to create a seam with four or more layers, and one or more couplings are formed in the seam with four or more layers to couple the first decking panel to the second decking panel.

In further accord with an embodiment of the invention, the male lip comprises a first male layer and a second male layer. The second male layer is folded over the first male layer to form a male lip with two layers.

In another embodiment of the invention, the second male layer is an inwardly folded second male layer or an outwardly folded second male layer.

In yet another embodiment of the invention, the second male layer is folded in an open configuration or a closed configuration.

In still another embodiment of the invention, the one or more couplings are top-seam welds or side-seam welds in the seam.

In further accord with an embodiment of the invention, the one or more couplings are tabs that are formed in the seam by shearing through the four or more layers.

In another embodiment of the invention, the one or more couplings in the seam with the four or more layers improves the shear strength of the seam by greater than 5 percent over a three-layer seam with the one or more couplings.

In yet another embodiment of the invention, the one or more couplings in the seam with the four or more layers of the structural decking system results in a shear strength that is the same as or similar to a three-layer seam shear strength with at least 5 percent fewer couplings in the seam with the four or more layers.

In still another embodiment of the invention, the one or more couplings in the seam with the four or more layers of the structural decking system results in a shear strength that is the same as or similar to a three-layer seam shear strength with a material thickness of the first or second decking panels that is at least 5 percent thinner than the three-layer seam decking panel thickness.

In further accord with an embodiment of the invention, the first panel and the second panel of the decking system has a first material thickness, a first number of couplings from the one or more couplings, and a first shear strength that is the same or similar to a second shear strength of a second decking system utilizing a three-layer seam having a second material thickness greater than the first material thickness and a second number of couplings greater than the first number of couplings, and wherein a length and a width of the decking system is the same as the second decking system.

Another embodiment of the invention comprises a structural decking system for a building structure. The structural decking system comprises two or more support members, a first decking panel comprising first top flanges, first bottom flanges, first webs, and at least one edge comprising a male lip, wherein the first decking panel is operatively coupled to at least one of the two or more support members, and a second decking panel comprising second top flanges, second bottom flanges, second webs, and at least one edge comprising a female lip, wherein the second decking panel is operatively coupled to at least one of the two or more support members. The female lip of the second decking panel is placed over the male lip of the first decking panel to create a seam with four or more layers, and one or more couplings are formed in the seam to couple the first decking panel to the second decking panel.

In further accord with an embodiment of the invention, the male lip comprises a first male layer, a second male layer, and wherein the second male layer is folded over the first male layer to form a male lip with two layers.

In another embodiment of the invention, the second male layer is an inwardly folded second male layer or an outwardly folded second male layer, and the second male layer is folded in an open configuration or a closed configuration.

In yet another embodiment of the invention, the one or more couplings are top-seam welds or side-seam welds in the seam.

In still another embodiment of the invention, the one or more couplings are tabs that are formed in the seam by shearing, or shearing and deforming, through the seam with the four or more layers.

In further accord with an embodiment of the invention, the one or more couplings in the seam with four or more layers improves the shear strength of the seam by greater than 5 percent over a three-layer seam with the one or more couplings.

In another embodiment of the invention, the one or more couplings in the seam with the four or more layers of the structural decking system results in a seam shear strength that is the same as or similar to a three-layer seam shear strength with at least 5 percent fewer couplings in the seam with the four or more layers.

In yet another embodiment of the invention, the one or more couplings in the seam with the four or more layers of the structural decking system results in a seam shear strength that is the same as or similar to a three-layer seam shear strength with a material thickness of the first or second decking panels that is at least 5 percent thinner than the three-layer seam decking panel thickness.

In still another embodiment of the invention, the first panel and the second panel of the decking system has a first material thickness, a first number of couplings from the one or more couplings, and a first shear strength that is the same or similar to a second shear strength of a second decking system utilizing a three-layer seam having a second material thickness greater than the first material thickness and a second number of couplings greater than the first number of couplings, and wherein a length and a width of the decking system is the same as the second decking system.

Another embodiment of the invention comprises a method of assembling a decking system. The method comprises assembling a first decking panel to at least one of two or more support members, wherein the first decking panel comprises first top flanges, first bottom flanges, first webs, and at least one edge comprising a male lip. The method further comprises assembling a second decking panel to at least one of the two or more support members, wherein the second decking panel comprises second top flanges, second bottom flanges, second webs, and at least one edge comprising a female lip. The method comprises assembling the female lip of the second decking panel over the male lip of the first decking panel to create a seam with four or more layers, and forming one or more couplings in the seam to couple the first decking panel to the second decking panel.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detail description of the invention taken in conjunction with the accompanying drawings, which illustrate embodiments of the invention and which are not necessarily drawn to scale, wherein.

DETAILED DESCRIPTION

Figure 1A:
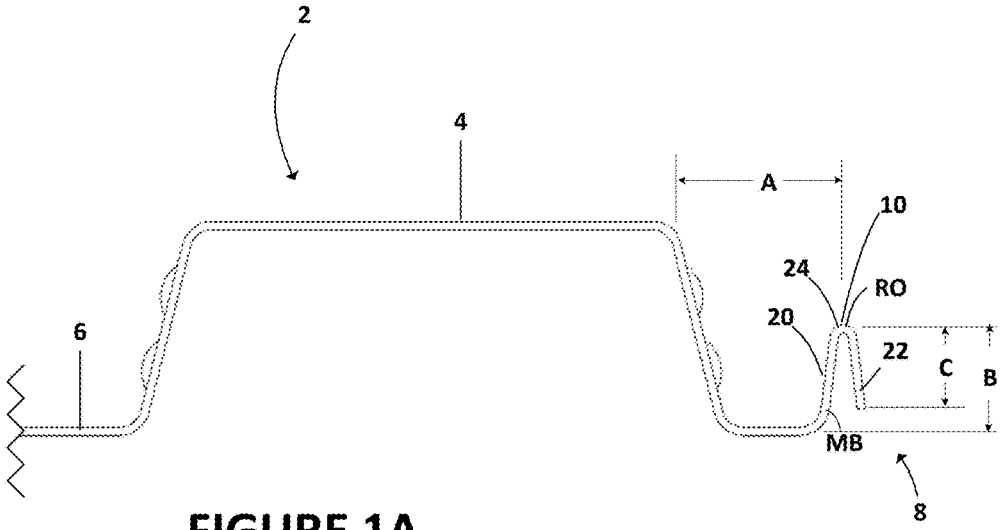
FIG. 1A illustrates a profile view of a portion of a structural decking panel having a male lip with an open outward fold, in accordance with embodiments of the present invention.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

The present invention relates to methods for manufacturing and assembling structural decking panels, as well as the structural decking systems formed from the methods. The present invention relates to decking panels with various types of generally upright side-lap seams (e.g., vertical seams or located at various angles from the vertical orientation that are perpendicular or generally perpendicular to the plane of the decking panels 2) having a male lip on an edge of a first decking panel and a female lip on an edge of an adjacent second decking panel. The seam formed from the male lip and the female lip includes a total of at least four layers when the female lip is placed over the male lip. In other embodiments, there may be additional layers in the seam, such as five layers, six layers, or the like. A four layer seam may provide the desired results (e.g., prevent or reduce vertical separation, prevent or minimize lateral shifting along the seam, and ensure a desired level of shear strength and/or stiffness across the structural decking) when couplings (e.g., welds, sheared sections, fasteners, or the like) are formed in the seam, while still allowing for access to the seam and the ability to cut or weld the four layers of the generally upright seam in order to create the couplings.

In some embodiments, the four or more layers of the seam are cut (e.g., sheared through, punched through, or the like) in multiple locations along the seam in order to couple the first decking panel to the second decking panel. In other embodiments the four or more layers of the seam are welded through a side seam weld or a top seam weld. In some of the couplings the side seam weld or top seam weld may not engage all of the four or more layers. The locations of the couplings in the seam may be placed at specific intervals or interval ranges in order provide the desired shear strength along the length of the seam of the assembled structural decking. The distances at which the couplings are formed in the seam will be discussed in further detail later.

The decking panels 2 used to form the structural decking may be manufactured from a variety of rigid materials including steel, aluminum, titanium, plastic, a composite, or another type of rigid material. Typical decking panels are made of steel and are sized in ranges from 12 inches to 42 inches wide by 1 foot to 50 feet long. These dimensions include some sizes of structural decking, but it should be understood that any sizes of structural decking within these ranges, overlapping these ranges, or outside of these ranges might be utilized with the present invention. The material thickness of the decking panels 2 may be any thickness; however, typical panel thicknesses may range between 22 gage and 16 gage, inclusive. Other material thicknesses of the present invention may be within this range, overlap this range, or be located outside of this range.

The decking panels 2 may have profiles that include top flanges 4 (otherwise described as longitudinal peaks or top flute portions) 4 and bottom flanges 6 (otherwise described as longitudinal troughs or bottom flute portions), which will be generally discussed in further detail below. The top flanges 4 and the bottom flanges 6 are operatively coupled together through the use of a web 5 (e.g., members that are perpendicular or sloped with respect to the flanges). A flute is defined as a top flange 4, the webs 5 on both sides of the top flange 4, and a half of the bottom flanges 6 extending from the webs 5 on both sides of the top flange 4. Multiple flutes form the profile of a steel decking panel 2.

The profiles of the decking panels 2 may be referred to as "fluted profiles," "hat profiles", "flat-bottomed profiles", "triangular profiles," "trapezoidal profiles," or other like profiles. The distance from the top of the top flange 4 and the bottom of the bottom flange 6 may generally range from 1½ inches to 3 inches in depth; however other ranges of depths within this range, overlapping this range, or outside of this range may be used in the profiles. For example, in some embodiments the distance may range from 1 inch to 12 inches in depth, or the like (e.g., for the profiles illustrated in FIGS. 9F and 9G, as well as the other profiles whether or not they are specifically illustrated herein). The panels 2 may or may not include longitudinal ribs, bends, or cutouts that provide the desired (e.g., intended, required, or the like) structural strength and/or stiffness to the panels 2. Depending on the material thickness, the length and width of the panels 2, and the height of the top flanges 4 and bottom flanges 6, the panels 2 may weigh between 100 and 420 lbs. In other embodiments, the weight of the panels may be within, overlap, or be located outside of this range.

The sizes and thicknesses of the decking panels 2 are determined based on the engineering requirements for the desired application of the structural decking. In one particular embodiment of the invention, the decking panels 2 are used as roofs and are required to meet the structural requirements for withstanding potential seismic activity, high winds, and/or other natural or man-made forces. As discussed in further detail below, if the couplings are not properly spaced along the seam or are not formed properly within the seam, the weakest location of the roof decking may be along the seam of the roof decking. As described herein, the present invention provides improved seams and couplings of the decking panels 2, which allows for the increased shear strengths and/or stiffness at the seams, and thus allows for a reduced thickness of the decking panels 2 and/or couplings that are spaced farther apart from one another without decreasing the shear strength of the overall system. As such, the reduced thickness of the decking panels 2 reduces the material costs and/or the reduced number of couplings reduces the labor costs associated with the decking systems of the present invention, when compared with other decking systems that have the same or similar shear strength.

Each decking panel 2 may be formed (e.g., roll-formed, or the like) into the desired profile. Typically, the decking panel 2 profile includes top flanges 4 and bottom flanges 6 of different shapes and sizes which create the various types of profiles (e.g., hat profiles, vee profiles, triangular profiles, dovetail profiles, or any other type of decking profile) described in further detail later. The top flanges 4 and bottom flanges 6 provide the desired strength and/or stiffness of the decking panels 2.

Panel edges 8 (e.g., the opposite longer sides of the decking panel 2) may be formed into lips that couple a first decking panel 2 to an adjacent second decking panel 2. The lips on opposite edges 8 of a decking panel 2 may include a "male lip" 10 and a "female lip" 12, which interlock with the opposing lips on adjacent decking panels 2. For example, adjacent decking panels 2 may be coupled together by mating the male lip 10 of a first decking panel edge 8 with the female lip 12 of a second decking panel edge 8. The male lip 10 and the female lip 12 may be dimensioned in order to allow for tolerance differences, such that the female lip 12 may fit over the male lip 10 over the length of the edge of the decking panel edges 8 without the use of tools in order to form an unjoined seam 14. In alternate embodiments, the male lip 10 and the female lip 12 may be dimensioned in order to allow for a press fit between the lips. As will be explained in further detail, couplings (also described as connections, attachments, or the like) may be formed in the seam 14 of the decking panels 2 to couple adjacent decking panels 2 to each other. Multiple decking panels 2 may be modularly configured to create a variety of differently sized floors or roofing arrangements (e.g., different parts of the floor or roof may have different panels with different material thicknesses). In other embodiments of the invention, a first decking panel 2 may have two male lips 10 on each edge 8 and a second decking panel 2 may have two female lips 12 on each edge 8, such that the decking panels are alternated when assembled to form the structural decking.

One decking panel edge 8 may include a generally vertical male lip 10 (e.g., located between 45 degrees+/− from a perpendicular orientation with the horizontal plane of the decking panel, or the like) as illustrated in FIGS. 1A-2B and 4A-7D. The male lip 10 may be offset from one of the decking top flanges 4 such that there is room for the male lip 10 of a first decking panel 2 to interlock with a female lip 12 of an adjacent second decking panel 2, and moreover, there is enough room to insert a tool (e.g., cutting tool, welding tool, or fastening tool) between adjacent decking top flanges 4 in order to couple the decking panels 2 together at the four-layered seam 14. In some embodiments, the male lip 10 is offset at a distance "A" from a top corner of the rib 4, wherein the distance A is approximately 1.15 inches, or within the range of 1 to 4 inches, inclusive. It should be understood that in other embodiments of the present invention the distance A may be within this range, outside of this range, or overlapping this range.

The male lip 10 may be created at one of the decking panel edges 8 by roll forming (or other like operation) the decking panel edge 8 into a generally inverted U-shape, V-shape, or other like shape. The male lip 10 may have a first male lip layer 20 that is extended generally vertically, for example at an angle "MB" from the horizontal orientation of the decking panel 8, as illustrated in FIG. 1A. In some embodiments of the invention the angle MB may be 83 degrees or may range from 60 to 120 degrees. It should be understood that in other embodiments of the present invention the angle MB may be within this range, outside of this range, or overlapping this range. In some embodiments, the height "B" of the first male lip layer 20 may range between 0.5 to 1.5 inches, and in one embodiment may have a height of 0.875 inches. In other embodiments of the invention, the height B of the first male lip layer 20 may be within the stated range, outside of the stated range, or overlapping the stated range depending on the type of profile and material thickness of the decking panels 2 used.

As illustrated in FIG. 1A, the male lip 10 may have a second male lip layer 22 that is folded outwardly towards the outside of the decking panel edge 8, as depicted in FIGS. 1A, 2A, 4A, 4C, 6A, and 7A. The second male lip layer 22 may have a height "C" in the outward direction, which may be 0.75 inches, or range from 0.375 to 1.375 inches in some embodiments. In other embodiments of the invention, the height of the second male lip layer 22 may be within this range, outside of this range, or overlapping this range depending on the type of profile and material thickness of the decking panels 2 used.

Figure 1B:
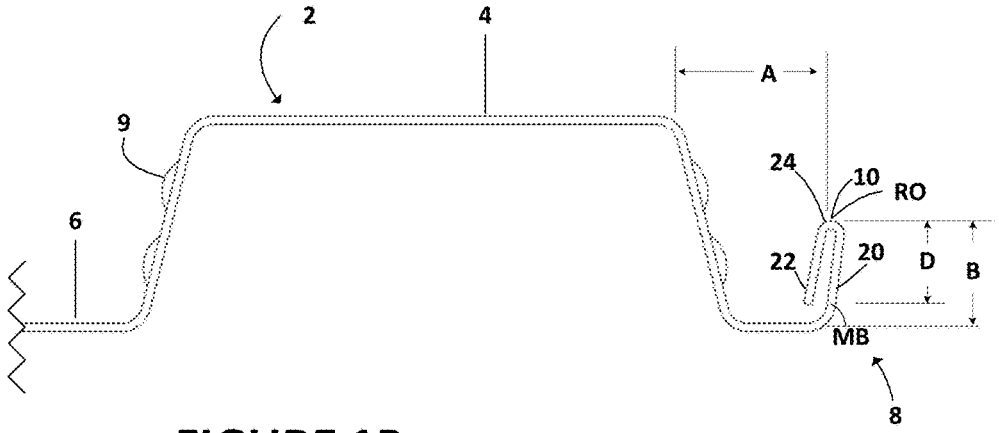
FIG. 1B illustrates a profile view of a portion of a structural decking panel having a male lip with an open inward fold, in accordance with embodiments of the present invention.
Figure 2A:
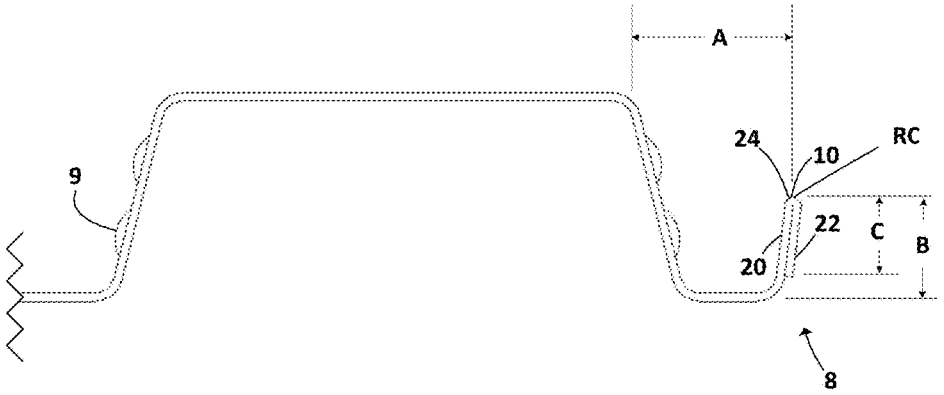
FIG. 2A illustrates a profile view of a portion of a structural decking panel having a male lip with a closed outward fold, in accordance with embodiments of the present invention.
Figure 2B:
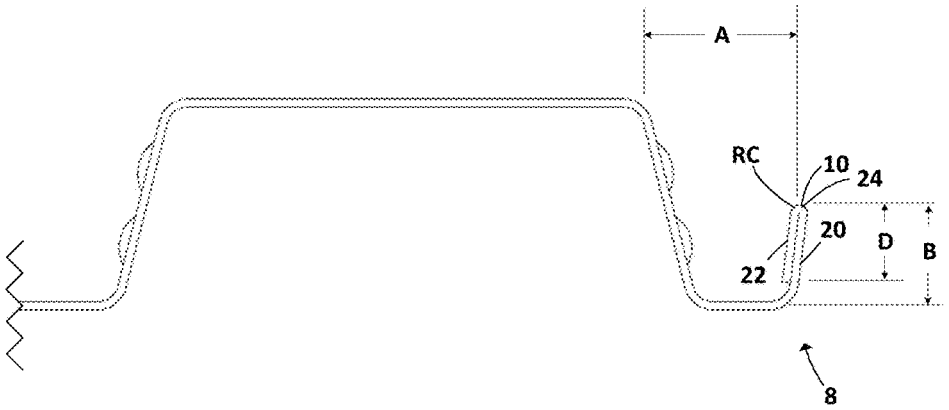
FIG. 2B illustrates a profile view of a portion of a structural decking panel having a male lip with a closed inward fold, in accordance with embodiments of the present invention.

In other embodiments, as illustrated in FIG. 1B, the second male lip layer 22 may be folded inwardly towards the inside of the decking panel edge 8, as depicted in FIGS. 1B, 2B, 4B, 4D, 5A, 5B, 6C, 6D, and 7C. The second male lip layer 22 may have a height "D" in the inward direction, which may be 0.75 inches, or range from 0.375 to 1.375 inches in some embodiments. In other embodiments of the invention, the height of the second male lip layer 22 may be within this range, outside of this range, or overlapping this range depending on the type of profile and material thickness of the decking panels 2 used.

In some embodiments, the male lip 10 may have a second male lip layer 22 that is folded in an open configuration to the inside or the outside of the decking panel edge 8 (e.g., inwardly or outwardly), as depicted in FIGS. 1A, 1B, 4A, and 4B. The open configuration may include a second male lip layer 22 that has an end that diverges away from the first male lip layer 20. The distance between the end of the second male lip layer 22 and the first male lip layer 20 may range from 0.1 to 0.5 inches. In other embodiments of the invention, the distance between the end of the second male lip layer 22 and the first male lip layer 20 may be within this range, outside of this range, or overlapping this range.

In one embodiment of the invention the bend radius "RO" of the male lip 10 in the open configuration may be 0.0625 inches, in other embodiments the bend radius may range from 0.01 to 0.375. In other embodiments of the invention, the bend radius "RO" of the male lip 10 in the open configuration may be within this range, outside of this range, or overlapping this range.

In other embodiments, the second male lip layer 22 may be folded in a closed configuration to the inside or the outside of the decking panel edge 8 (e.g., inwardly or outwardly), as depicted in FIGS. 2A, 2B, 4C, and 4D. The closed configuration may include a second male lip layer 22 that is parallel with, overlays, or has an end that converges towards the first male lip layer 20. In some embodiments of the invention the space between the first male layer 20 and the second male layer 22 may be as close as possible, however, there may be gaps between the second male lip layer 22 and the first male lip layer 20. In one embodiment of the invention the bend radius "RC" of the male lip 10 in the closed configuration may be 0.01 inches, in other embodiments the bend radius may range from 0.0 to 0.125. In other embodiments of the invention, the bend radius "RC" of the male lip 10 in the closed configuration may be within this range, outside of this range, or overlapping this range.

When folded, the male lip 10 typically includes a thickness of two layers of the decking panel 2 as illustrated in FIGS. 1A-2B and 4A-8. By including two decking panel layers in the male lip 10, the strength of the male lip 10 with two-layers is improved over the strength of a male lip with a single male lip layer along the decking panel edge 8. As such, the male lip 10 with two layers is less likely to be bent out of position before installation, and has improved strength even before the female lip 12 of an adjacent decking panel 2 is placed over the male lip 10 and the couplings are created. Moreover, after the couplings are formed the shear strength of the seam 14 formed by coupling the two layer male lip 10 to the two layer female lip 12 increases the shear strength of the seam, thus allowing for the use of a reduced number of couplings and/or reduced material thickness of the decking panels 2 (e.g., as determined before the decking is installed). As such, utilization of the two-layer male lip 10 may enable the use of decking panels 2 with reduced material thicknesses (e.g., higher gage panels) to achieve the same or similar shear strengths along the seam as decking panels 2 with greater material thicknesses (e.g., lower gage panels) that utilize a single layer male lip and/or more couplings, as will be illustrated in further detail below.

Figure 3:
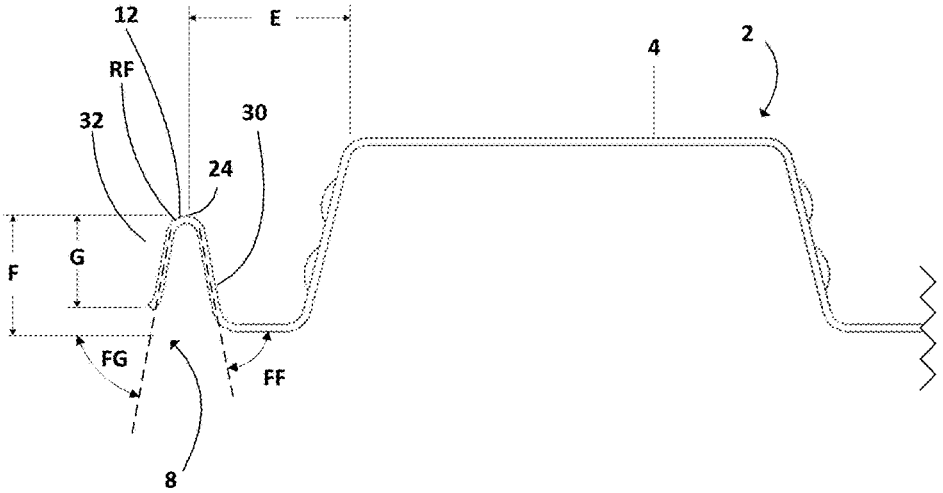
FIG. 3 illustrates a profile view of a portion of a structural decking panel having a female lip, in accordance with embodiments of the present invention.
Figure 4A:
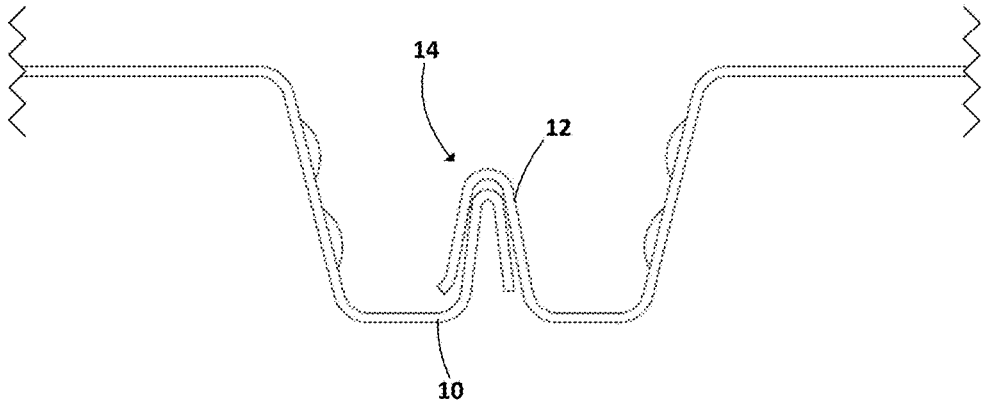
FIG. 4A illustrates a profile view of a first decking male lip with an open outward fold located within a second decking female lip, in accordance with embodiments of the present invention.
Figure 4B:
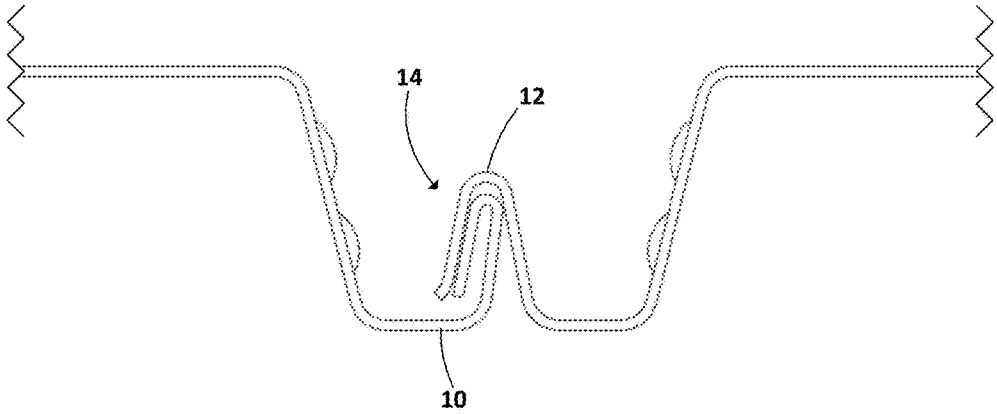
FIG. 4B illustrates a profile view of a first decking male lip with an open inward fold located within a second decking female lip, in accordance with embodiments of the present invention.
Figure 4C:
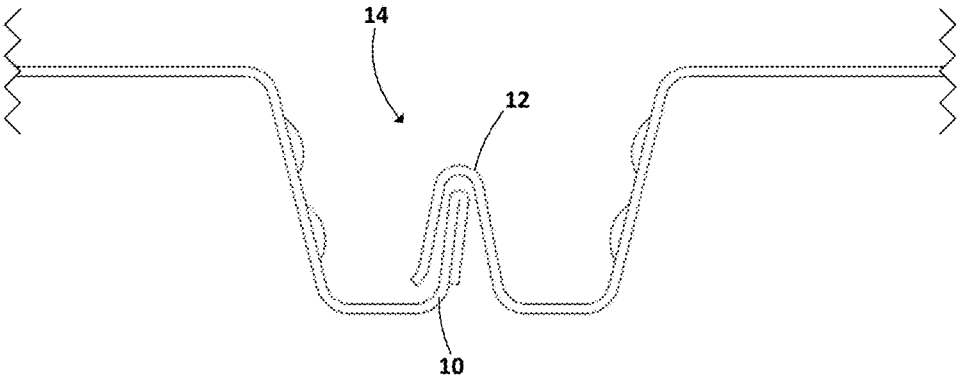
FIG. 4C illustrates a profile view of a first decking male lip with a closed outward fold within a second decking female lip, in accordance with embodiments of the present invention.
Figure 4D:
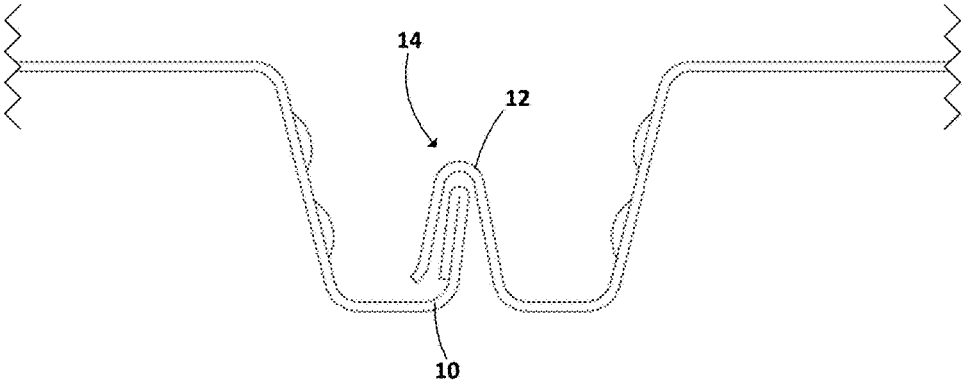
FIG. 4D illustrates a profile view of mating a first decking male lip with a closed inward fold located within a second decking with female lip, in accordance with embodiments of the present invention.

The decking panel edge 8 on the opposite side of the decking panel as the male lip 10 may include an inverted "U" shaped female lip 12 as shown in FIG. 3. Like the male lip 10, the female lip 12 may be generally vertical (e.g., located between 45 degrees+/− from a perpendicular orientation with the horizontal plane of the decking panel, or the like) as illustrated in FIG. 3. The female lip 12 may be offset from the adjacent decking top flange 4 such that there is room for the female lip 12 of the second decking panel 2 to interlock with the male lip 10 of an adjacent first decking panel 2, and moreover, there is room to insert a tool (e.g., cutting tool, welding tool, or fastening tool) between the decking top flanges 4 of adjacent panels 2 in order to couple the adjacent decking panels 2 together at the four-layered seam 14. In some embodiments, the female lip 12 is offset at a distance "E" from a top corner of the adjacent top flange 4, wherein the distance E is approximately 1.5 inches, or within the range of 1.0 to 4.0 inches. In other embodiments of the invention the distance E may be within this range, outside of this range, or overlapping this range.

The female lip 12, in some embodiments, is configured to substantially cover the male lip 10 (e.g., configured to receive the male lip 10), such that the female lip 12 is typically larger than the male lip 10. The female lip 12 may be formed by folding the decking panel edge 8 into an "inverted U" or "inverted V" shape, or other like shape with a channel that fits over the male lip 10. The female lip 12 may have a first female lip layer 30 that is extended generally vertically, for example at an angle "FF" from the horizontal orientation of the decking panel 8. In some embodiments of the invention the angle FF may be 79 degrees or may range from 60 to 120 degrees. It should be understood that in other embodiments of the present invention the angle FF may be within this range, outside of this range, or overlapping this range.

In some embodiments, the height "F" of the first female lip layer 30 may range between 0.625 to 1.625 inches, and in one embodiment may have a height of 0.875 inches. In other embodiments of the invention, the height F of the first female lip layer 30 may be within, overlap, or fall outside of the stated range depending on the type of profile and material thickness of the panel 2 used.

The female lip 12 may have a second female lip layer 32 that is folded outwardly towards the outside of the decking panel edge 8, as depicted in FIGS. 3-8. The second female lip layer 32 may extend generally vertically, for example at an angle "FG" from the horizontal orientation of the decking panel 8. In some embodiments of the invention the angle FG may be 85 degrees or may range from 60 to 120 degrees. It should be understood that in other embodiments of the present invention the angle FG may be within this range, outside of this range, or overlap this range.

The second female lip layer 32 may have a height "G," which may be 0.75 inches, or range from 0.5 to 1.5 inches in some embodiments. In other embodiments of the invention, the height G of the second female lip layer 32 may be within, overlap, or fall outside of this range depending on the type of profile and material thickness of the decking panels 2 used.

As shown in FIG. 3, the female lip 12 may have a bend radius "RF," wherein in some embodiments the bend radius RF is 0.125 inches, or in other embodiments may range from 0.01 to 0.375 inches. In other embodiments of the invention, the bend radius RF of the female lip 12 may be within, overlap, or fall outside of this range depending on the type of profile and material thickness of the decking panels 2 used.

In order to couple two adjacent panels 2 together, the male lip 10 of a first decking panel 2 may be received by a female lip 12 of a second decking panel 2. The female lip 12 may be placed over the male lip 10 as depicted in FIGS. 4A through 4D to create a seam 14 (e.g., a side-lap seam) along the length of adjacent decking panel edges 8. The purpose of the seam 14 formed after coupling (e.g., cutting, deforming, welding, fastening, or the like) is to couple two adjacent decking panels 2 securely to each other in order to prevent one panel from lifting off another panel, preventing lateral movement between the adjacent decking panels 2, and providing the desired shear strength of the decking system, such that decking system, including the seam 14, meets the structural requirements for the application. When the male lip 10 and female lip 12 are coupled, the seam 14 may include four layers of decking panel material, in which two of the layers are associated with the male lip 10 and two of the layers are associated with the female lip 12. In other embodiments of the invention the seam 14 may have additional layers to further improve the shear strength of the decking system. For example, a five layer seam, a six layer seam, or the like formed by having additional folds on the male lip 10 (e.g., three layers) or on the female lip 12 (e.g., three layers) may be utilized in the present invention.

However, in some embodiments of the invention the tools used to cut (e.g., shear or punch) a five layer seam, six layer seam, or the like may need additional power to cut the layers in the seam while still operating between adjacent top flanges 4 of adjacent panels 2 of the structural steel decking.

Figure 5A:
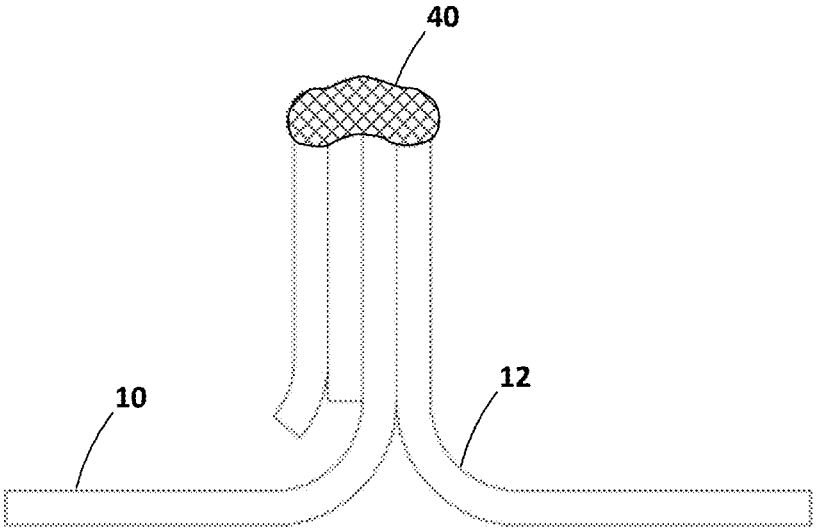
FIG. 5A illustrates a cross-sectional view of a top seam weld coupling in a seam with a first decking male lip with a closed inward fold and a second decking female lip, in accordance with embodiments of the present invention.

In one embodiment of the invention the four-layer seam (or five-layer, six-layer, or the like) may be top-seam welded or side-seam welded in order to create the coupling (also described as a joint, connection, attachment, or the like) between adjacent decking panels 2. As illustrated by FIG. 5A the top seam weld may fuse the top 34 of the female lip 12 with the top 24 of the male lip 10. Additionally, in some embodiments, as illustrated in FIG. 5A filler material 40 may be added to form a pool of metal along with the metal from the female lip 12 and the male lip 10 in order to form an effective weld. A weld formed on the four-layer seam 14 is an improvement over a three-layer seam because of the additional layer of material provided in the male lip 10. When welding three-layer seams, burn through may occur when the filler material 40 burns through not only the female lip 12, but also through the single layer of the male lip 10, which causes a defective weld. A defective weld may result in additional time for a welder to patch the weld, and even after patching the weld may not have the desired shear strength. The extra layer of material in the male lip 10 of the present invention allows for additional material that is less likely to be burned through during the welding process. Particularly, using the closed male lip 10 illustrated in FIG. 5A may be better than using an open male lip 10 (not illustrated) during welding because burn through may be less likely when the layers are folded on top of each other since there is little or no space between the layers to allow for burn through of the filler material 40. This is particularly true as the material thickness of the decking panels 2 become thinner. FIG. 5A illustrates a male fitting with an inwardly folded second male lip layer 22; however it should be understood that the top seam weld may be utilized with an outwardly folded second male lip layer 22. The outwardly or inwardly folded second male lip layer may be folded in an open or closed configuration. It should be noted that in some embodiments, after the female lip 12 is placed over the male lip 10, the female lip 12 and/or the male lip 10 might be deformed (e.g., crimped, or the like) before being welded.

Figure 5B:
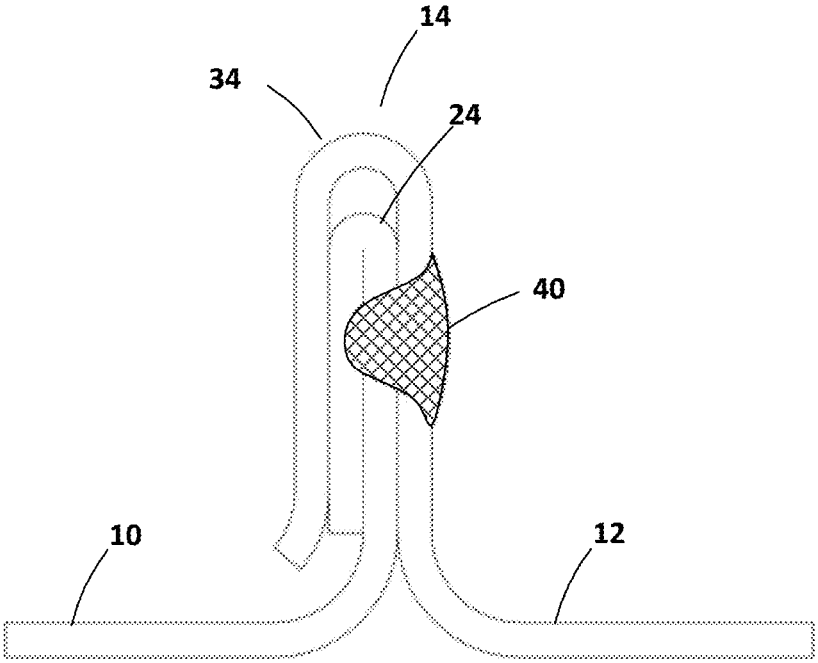
FIG. 5B illustrates a cross-section view of a side seam weld coupling in a seam with a first decking male lip with a closed inward fold and a second decking female lip, in accordance with embodiments of the present invention.

In other embodiments, as illustrated in FIG. 5B a side-seam weld may be utilized to create the couplings in the seam 14. As was described with respect to the top seam weld, and as illustrated in FIG. 5B, the side seam weld may fuse the one or more layers of the four-layer seam 14 and/or utilize filler material to create the welded coupling. Also, like with top-seam weld, when only three layers are present burn through may occur through the three layers, and as such, the coupling may not be formed properly and the shear strength of the coupling may be reduced. As such, the presence of the fourth layer (or additional layers) provides additional material that helps to prevent burn through. However, the presence of the fourth layer may also make it more difficult to create a weld through all four layers. Moreover, the space limitations on either side of the generally vertical seam 14 between the top flanges 4 of adjacent decking panels 2 may make it difficult to access the side of the seam 14 in order to create the side-seam weld. As such, in some embodiments a top seam weld may be more effective and/or easier to form than a side-seam weld. FIG. 5B illustrates a male lip 10 with an inwardly folded second male lip layer 22; however, it should be understood that the side seam weld may be utilized with an outwardly folded second male lip layer 22. The outwardly or inwardly folded second male lip layer may be folded in an open or closed configuration. Moreover, as previously described the seam may be deformed (e.g., crimped, or the like) before being welded.

In other embodiments of the invention, instead of a welded seam 14, as previously discussed, the four-layer seam 14 may be deformed and/or cut (e.g., sheared) to couple the decking panels 2 together. In some embodiments of the invention a tool having jaws is used to form the couplings in the seam 14. The jaws (e.g., two or more opposed jaws) of the tool may span the seam 14 on either side of the generally upright seam 14. The jaws may perform the deformation and cutting operations, or the jaws may include blades, cavities, punches, dies, and/or any other feature that deforms and/or cuts at least a portion of the seam 14. When actuated, the jaws, and/or other feature on the jaws, deform and/or cut the seam (e.g., in any order) in order to form the coupling. The jaws may be manually actuated or actuated through a power source, such as but not limited to pneumatically actuated, hydraulically actuated, electromechanically actuated, or actuated using any other type of power source in order to create the coupling. Depending on the material thickness of the four layers of the seam 14, pneumatic or hydraulic actuation may be required in order to cut through the four layers (or more) of the seam 14.

Figure 6A:
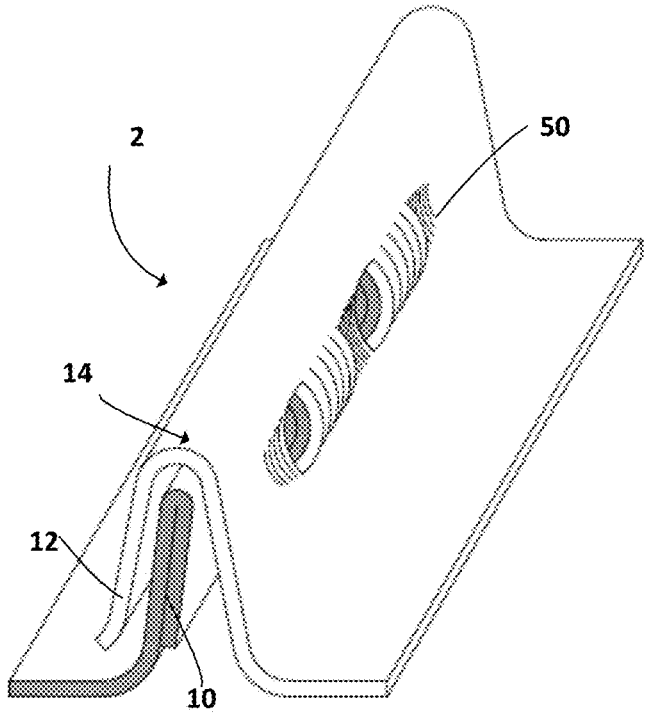
FIG. 6A illustrates a perspective view of a sheared and deformed coupling in a seam having a left decking male lip with a closed outward fold and a right decking female lip, in accordance with embodiments of the present invention.
Figure 6B:
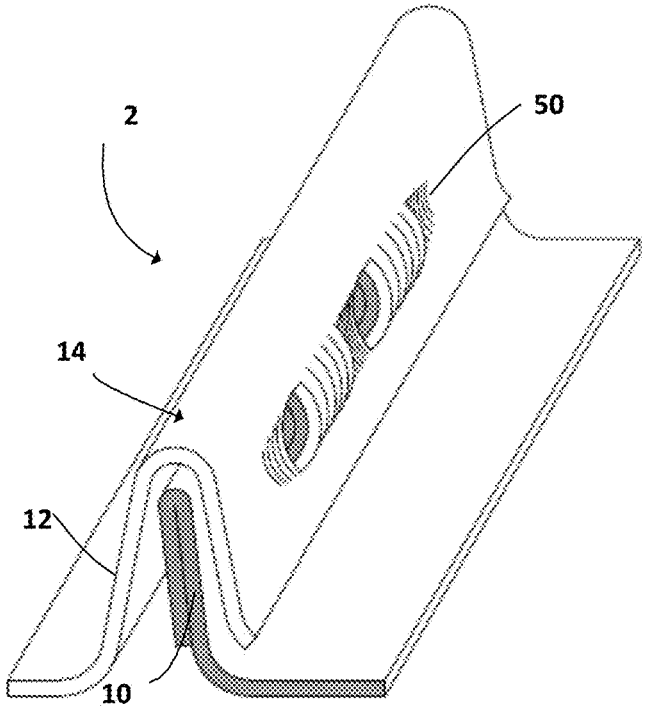
FIG. 6B illustrates a perspective view of a sheared and deformed coupling in a seam having a right decking male lip with a closed outward fold and a left decking female lip, in accordance with embodiments of the present invention.
Figure 6C:
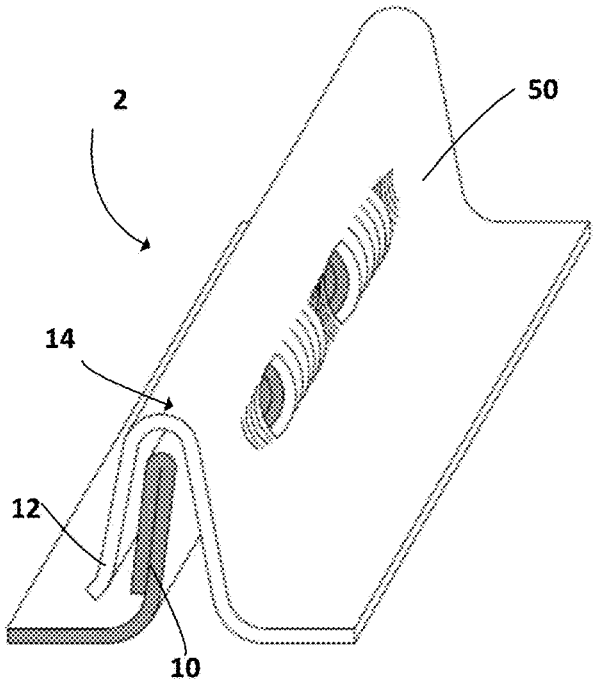
FIG. 6C illustrates a perspective view of a sheared and deformed coupling in a seam having a left decking male lip with a closed inward fold and a right decking female lip, in accordance with embodiments of the present invention.
Figure 6D:
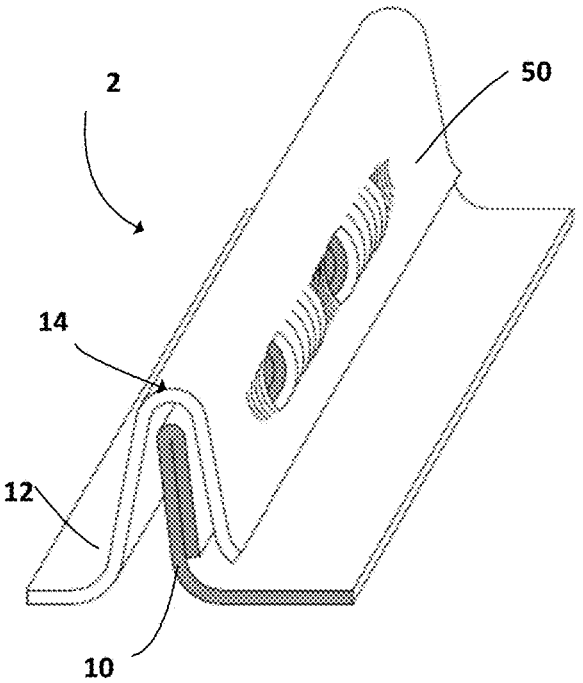
FIG. 6D illustrates a perspective view of a sheared and deformed coupling in a seam having a right decking male lip with a closed inward fold and a left decking female lip, in accordance with embodiments of the present invention.

In one embodiment cutting the seam 14 comprises shearing and deforming a portion of the seam 14 to create a louver that results in a tab that provides interference at the ends of the tab to resist lateral movement of the adjacent panels. FIGS. 6A, 6B, 6C, 6D, 7A, 7B, 7C, and 7D illustrate one embodiment of the shearing of the seam 14; however, it should be understood that other embodiments may comprise other configurations for cutting the seam 14 to achieve the results described herein. FIGS. 6A and 6B illustrate an outwardly folded closed male lip 10, while FIGS. 6C and 6D illustrate an inwardly folded closed male lip 10. FIGS. 6A and 6C illustrate embodiments where the male lip 10 is located on a left decking panel 2, while the female lip 12 is located on the right decking panel 2. FIGS. 6B and 6D illustrate embodiments where the male lip 10 is located on the right decking panel 2, while the female lip 12 is located on the left decking panel 2. All four figures illustrate a male lip 10 that is in a closed position; however, in other embodiments of the invention the male lip 10 may have a second male lip layer 22 that is in an open position. Regardless of the male lip 10 being in an open or closed folded position, in some embodiments, as the jaws are actuated the four layers of the seam are deformed, and thus, the deformation creates a male lip 10 having a closed folded configuration (e.g., if it wasn't already in a closed folded configuration). Additionally, the female lip 12 is deformed over the male lip 10 help secure the four layers of the seam 14 together at the location of the coupling.

Figure 7A:
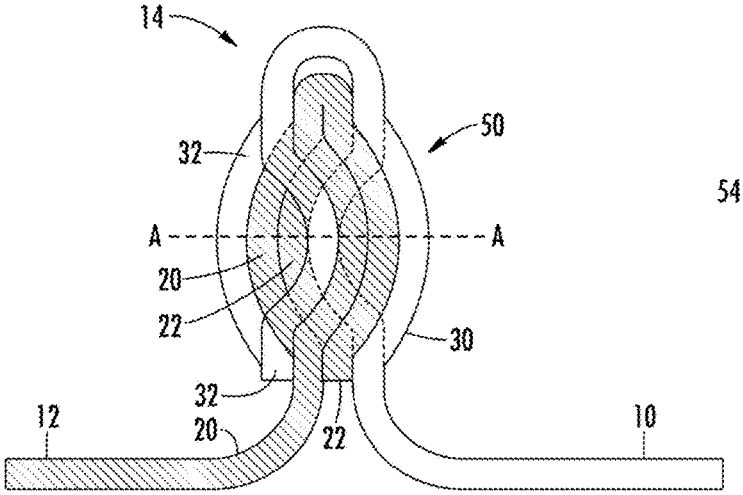
FIG. 7A illustrates a cross-sectional view of a sheared and deformed coupling in a seam having a male lip with an outward fold and a female lip, in accordance with embodiments of the present invention.
Figure 7B:
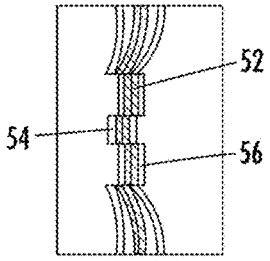
FIG. 7B illustrates a cross-sectional view of the sheared and deformed coupling in the seam of FIG. 7A along the section line A-A, in accordance with embodiments of the present invention.
Figure 7C:
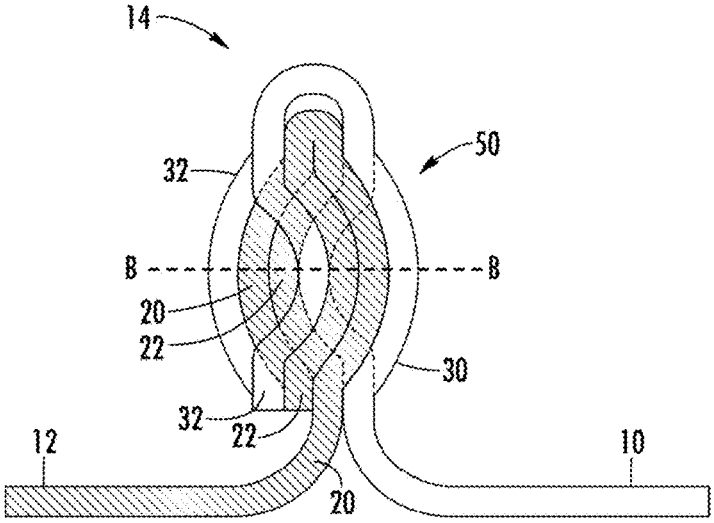
FIG. 7C illustrates a cross-sectional view of a sheared and deformed coupling in a seam having a male lip with an inward fold and a female lip, in accordance with embodiments of the present invention.
Figure 7D:
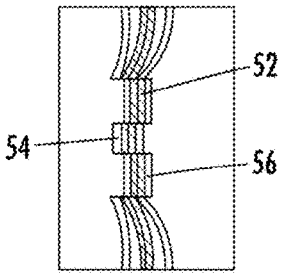
FIG. 7D illustrates a cross-sectional view of the sheared and deformed coupling in the seam of FIG. 7C along the section line B-B, in accordance with embodiments of the present invention.

As illustrated generally in FIGS. 6A to 6D, and in greater detail in FIGS. 7A to 7D, in some embodiments the tabs formed by the jaws (or by other features attached to the jaws) may be louvers, and may create multiple rectangular shaped louvers. FIG. 7A illustrates a seam 14 with a male lip 10 having a second male layer 22 folded outwardly in a closed configuration. FIG. 7B illustrates a cross sectional view of the male lip 10 in FIG. 7A along the section line A-A. Alternatively, FIG. 7C illustrates a seam 14 with a male lip 10 having a second male layer 22 folded inwardly in a closed configuration. FIG. 7D illustrates a cross sectional view of the male lip 10 in FIG. 7C along the section line B-B. In some embodiments, instead of rectangular tabs 50 (e.g., rectangular louvers) the portion of the seam 14 that is cut may form square, triangular, circular, oval, pentagonal, hexagonal, or any other like shape, or general shaped cutout in the seam 14 along with a corresponding tab. Regardless of the shape of the tab, the tab may create interferences between the male lip 10 layers and female lip 12 layers in order to, among other things, prevent or reduce the lateral movement of adjacent decking panels 2.

The number of cut locations at a particular coupling location in the seam 14 may vary depending on the desired shear strength, thicknesses of the layers, shape of the jaws (or shape of an attachment feature to the jaws). In some embodiments, only one tab 50 (e.g., one rectangular tab) may be sheared into a coupling location in the seam 14. However, in other embodiments multiple tabs (e.g. multiple louvers) may be sheared into the seam 14 at a particular coupling location. Namely, the coupling may contain two or more tabs 50 (e.g., two or more sheared rectangular louvers). More tabs 50 may theoretically mean better shear strength and resistance to lateral forces. As illustrated in FIGS. 7A to 7D, the tabs 50 (or other like couplings) may have an alternating configuration, such that one tab 50 extends or bows outwardly while an adjacent tab 50 extends or bows inwardly on the same side of the seam 14. Alternating the tabs 50 in this fashion may help to increase shear strength and resistance to lateral forces. FIGS. 7B to 7D illustrate one embodiment in which a first tab 52 is formed on a first side of the seam 14, a second tab 54 is formed on an opposite second side of the seam 14, and a third tab 56 is formed on the first side of the seam 14. It should be understood that any number of tabs (e.g. one or more) in any type of position (e.g., alternating or on the same side of the seam 14), and in any shape, might be utilized to create the coupling.

Figure 8:
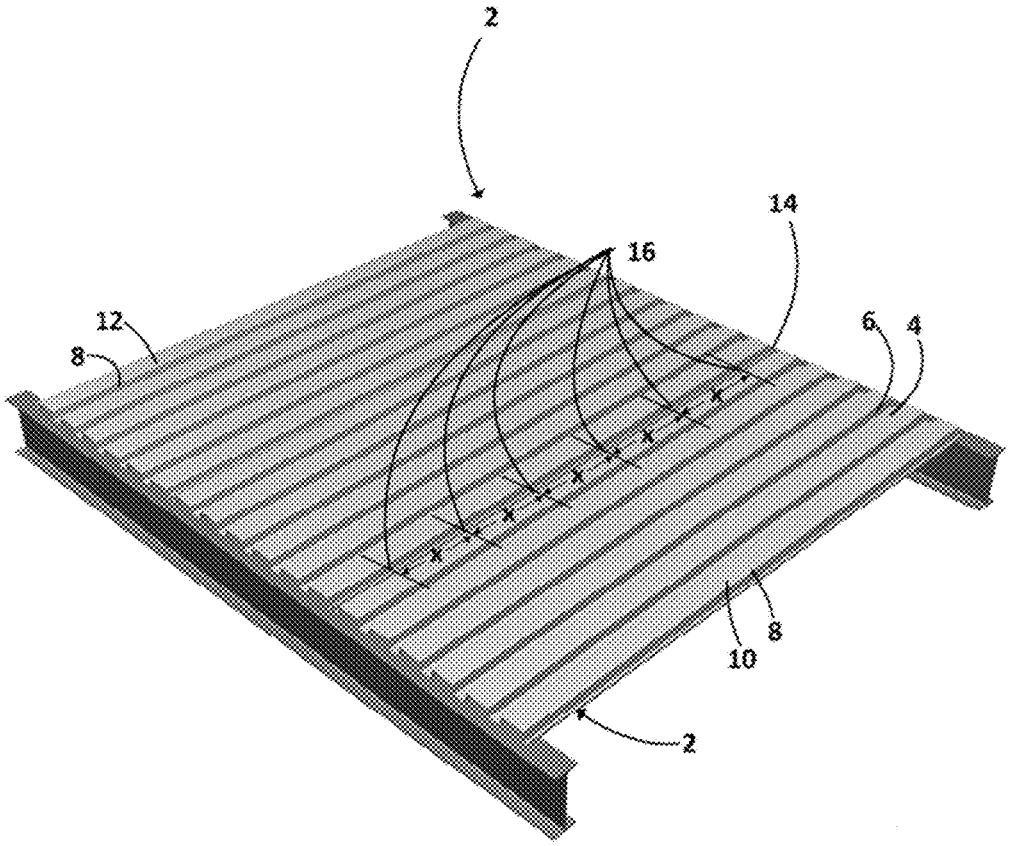
FIG. 8 illustrates a spacing of couplings along the seam of two coupled decking panels, in accordance with embodiments of the present invention.

The couplings in the seam 14 may be installed along the seam 14 at strategic distances from adjacent couplings. As depicted in FIG. 8, couplings may be installed at a predetermined distance "X" from each other. The value of "X," may range from 4 inches to 60 inches along the seam 14 based on the material thickness of the panels 2, the desired shear strength of the structural decking system, the type of couplings being formed (e.g., type of weld or type of cut connection), or other like factors. However, the range of the distance between couplings may be within the stated range, fall outside of the stated range, or overlap the stated range. The couplings may be installed using a generally uniform distance from each other, such that the distance "X" described may vary slightly, or may change over different locations on the seam depending on the requirements of each decking system. As such, the number of couplings and the locations of the couplings may vary within a panel length or between supports throughout the decking system. Installing couplings in an optimal pattern along the seam 14 may be based on a balance between the desired stability and shear strength of the structural decking system, and the installation time of the decking system.

Creating couplings in a four-layer seam 4 of the structural decking improves the shear strength of the seam 14 over a three-layer seam or a two-layer seam. As such, because of the improved shear strength in the four-layer seam 14, thinner material thicknesses may be used for the panels 2 and/or fewer couplings are needed to create a structural decking system that has a shear strength that is the same as or similar to the shear strength of a decking system that utilizes three-layer or two-layer seams. Therefore, using structural decking systems with four-layer seams 14 may result in structural decking systems that cost less due to reduced material costs (e.g., reduced price for thinner steel decking panels) and due to reduced assembly costs (e.g., assembly time is reduced due to less couplings).

As illustrated in Table 1 below the shear strength of the decking system using a four-layer seam 14 is improved over other seams utilized in decking systems, such as three-layer seams. Table 1 specifically illustrates two examples of the shear strength of a seam using a four-layer seam having a male lip 10 with two layers (one example with an open male lip configuration and one example with a closed male lip configuration) versus one example of the shear strength of a seam using a three-layer seam having a male lip 10 with a single layer. The shear strengths of the three seams were determined for various thicknesses of steel decking panels 2. In all three of the illustrated examples the seams (e.g., both the three-layer and four-layer seams) had the same couplings created in the seams. The couplings were all sheared seams that formed tabs as illustrated in FIGS. 7A to 7D. After shearing the seams in two (2) locations of adjacent decking panels 2, each with a single top flange 4, the panels 2 were assembled into the test rig with one panel 2 stationary and one panel 2 moveable. The moveable panel 2 was loaded until failure of the seam 14, and the maximum force before failure was measured.

As illustrated in Table 1, as the thicknesses of the decking panels increase (e.g., as the gage decreases from 22 to 20 to 18 to 16, or the like) the shear strength along the seam between two decking panels generally increases. However, when compared to a three-layer seam having a single male lip layer, a four-layer seam having a two male lip layers shows much better improvements in shear strength. For example, for decking panels that were 0.0299 inches thick (e.g., 22 gage) the two examples tested using the four-layer seams illustrated a 46% improvement in the shear strength (for both the open and closed configurations) over using the same type of coupling in a three-layer seam. With respect to the decking panels that were 0.0359 inches thick (e.g., 20 gage) the two examples tested using the four-layer seam illustrated an improvement in the shear strength of 53% (for the open male lip configuration) and 41% (for the closed male lip configuration), respectively, over the shear strength of the three-layer seam using the same type of coupling. With respect to the decking panels that were 0.478 inches thick (e.g., 18 gage) the two examples tested using the four-layer seam illustrated an improvement in the shear strength of 66% (for the open male lip configuration) and 62% (for the closed male lip configuration), respectively, over the shear strength of the three-layer seam using the same type of coupling. With respect to the decking panels that were 0.0598 inches thick (e.g., 16 gage) only the three layer seam was tested. It should be understood that four or more layers may be created in the seam of the 16 gage material, however, tests were not performed on the 16 gage material with a four-layer seam. As illustrated, the shear strength of the 16 gage material using a three-layer seam was 6628 lbs., while the shear strength of the four-layer seam using the 18 gage material (e.g., thinner than the 16 gage material) was 7717 lbs. As such, the four-layer seam using the thinner material provided improved shear strength of 16% over the three-layer seam using the thicker material.

TABLE 1

Test data comparing the shear strength of the three layer side-lap seam to the four layer side-lap seam

| | Design Base Metal | Seam with Single Layer Male | Seam with Open Double Layer Male | | Seam with Closed Double Layer Male | |
|---|---|---|---|---|---|---|
| Gage | Thickness t (in) | Shear Strength (lbs.) | Shear Strength (lbs.) | % Increase | Shear Strength (lbs.) | % Increase |
| 22 | 0.0299 | 2356 | 3431 | 46% | 3438 | 46% |
| 20 | 0.0359 | 3369 | 5164 | 53% | 4750 | 41% |
| 18 | 0.0478 | 4656 | 7717 | 66% | 7564 | 62% |
| 16 | 0.0598 | 6628 | — | — | — | — |

The values displayed in Table 1 relate to single results of testing of the four layer seams of the present invention versus three layer seams in one example. The actual repeatable product testing may provide different results, but generally it should be understood that with other variables being equal the four-layer seam provides improved shear strength when compared to three-layer seams. As such, based in part on Table 1, the use of a four-layer seam over a three-layer seam generally increases the shear strength of the seam. The increased shear strength, with all other factors being equal, shows at least a 40% improvement in the shear strength. However, in other embodiments of the invention, with smaller material thickness the shear strength of the four-layer seam may also illustrate an improvement over three-layer seams with larger material thicknesses. As such, in the present invention, the shear strength of the four layer seam, may have a 5, 10, 15, 20, 25, 30, 35, 40, 45, 50, 55, 60, 65, 70, 75, 80, 85, 90, 95, 100, 110, 120, 130, 150, or more percent improvement over the shear strength of a three-layer seam (e.g., with the other factors of panel thickness and number of couplings being equal). The improvement in shear strength may include a range that falls within, is outside of, or overlaps any of the percent values recited above. It should be noted that the shear strengths illustrated in Table 1 are for the isolated couplings within a sample of a decking system. Moreover, the shear strengths of the seam 14 may be less than, the same as, or greater than what is illustrated in Table 1 based on the type of couplings formed in the seam. For example, a different type of coupling formed by cutting (e.g., different than what is illustrated in FIGS. 6A-7D) may result in a shear strength that is less than, equal to, or greater than what is illustrated in Table 1. In another example, using a weld or a fastener (e.g., different types of fasteners) as couplings may result in a shear strength that is less than, equal to, or greater than what is illustrated in Table 1. However, it should be understood that utilizing the four-layer seam (or more than four layers) with various types of couplings may result in improved shear strength over the use of the same or similar couplings in a three-layer seam.

As previously discussed the increased shear strength utilizing the four-layer seam may be an improvement over a three-layer seam because not as many couplings would be needed in the four-layer seam in order to achieve the same or similar shear strength in the three-layer seam. In one example, with respect to Table 1, when using 18 gage panels with a ten (10) foot long seam of mating decking panels 10 and couplings that are located one foot apart (e.g., at 0.5 ft, 1.5 ft, 2.5 ft . . . 9.5 ft) a decking system that utilizes the three-layer seam may have a shear strength of 46,560 (e.g., 10 couplings multiplied by the 4656 lbs. shear strength of a single coupling in the 18 gage panel). In the present invention, the same system (e.g., 18 gage panels with a ten (10) foot long seam, and the same type of couplings) can achieve the same or similar shear strength in the four-layer seam by utilizing only 6 couplings (e.g., 46,560/7717 equals 6.033 couplings). This illustrates a 40% reduction in the amount of couplings. As such in some embodiments of the invention, depending on the gage thickness, the length of the seam, the type of four-layer seam, the type of couplings, or other like parameters, the number of couplings used in the four layer seam of the present invention may be reduced by 5, 10, 15, 20, 25, 30, 35, 40, 45, 50, 55, 60, 65, 70, 75, 80, 85, 90, 95, or more percent when compared to the number of couplings used in a three layer seam (e.g., with all the other factors of the systems being equal) while maintaining the same or similar shear strength. As such, the number of couplings may be reduced by any percentage illustrated or by any range that falls within, is outside of, or overlaps any of the percentages listed above. As illustrated in FIG. 8, the distance between the couplings 16 (e.g., "X") may be increased, and thus, the number of couplings along the seam 14 between two panels 2 of a decking system may be reduced by using the four-layer seam 14 instead of a three-layer seam. This reduces the assembly time of the system, which results in lower costs and improved safety (e.g., the workers spend less time on roofs installing the systems).

As previously discussed the increased shear strength utilizing the four-layer seam may be an improvement over a three-layer seam because using the four-layer seam may allow a four-layer seam system to drop gage thicknesses (e.g., move from 18 gage to 20 gage) without sacrificing shear strength. As illustrated in Table 1, by using either the open double layer male lip or the closed double layer male lip, a system may be able to utilize 20 gage panels using the four layer seam to achieve a shear strength (e.g., 5164 lbs. or 4750 lbs.) that is the same or similar to the shear strength (e.g., 4656 lbs.) using a three-layer seam with an 18 gage panel (e.g., thicker than the 20 gage panel) and the same number of couplings. In some embodiments of the invention, a reduction in the thickness of the panels (e.g., a drop down in the gage thickness from 18 to 20, or any other drop) may not be achieved without also increasing the number couplings used in the four-layer seam. This would only occur when a reduction in the thickness of the panels using a four-layer seam with the same number of couplings as the three-layer seam using the thicker panels would not result in the same shear strength. Adding additional couplings in the four-layer seam may achieve the desired shear strength, while still reducing costs because the material is less expensive (e.g., thinner decking panels), even though creating the additional couplings in the seam would increase the cost of assembly. As such, in some embodiments of the invention, depending on the gage thickness, the length of the seam, the type of four-layer seam, the type of couplings, or other like parameters, the thickness (or in other embodiments of the invention the weight) of the panels may be reduced by 5, 10, 15, 20, 25, 30, 35, 40, 45, 50, 55, 60, 65, 70, 75, 80, 85, 90, 95, or more percent, while still achieving the same shear strength as a three layer seam that utilizes the same, more, or in some cases less couplings. As illustrated in FIG. 8, the system may use thinner panels 2 based on utilizing the four-layer seam of the present invention. As illustrated in FIG. 8, the thickness of the panels 2 of the decking system may be reduced using the four-layer seam 14, while the number of couplings along the seam 14 between the two panels 2 of a decking system remain the same (e.g., the distance "X" does not change with respect to the three-layer seam). This reduces the weight of the decking panels and the amount of steel used, which results in lower costs associated with the decking systems. In some embodiments, both the thicknesses of the panels and the number of couplings used in the four-layer seam systems, when compared to the three-layer seam systems, may be reduced to improve the cost, weight, assembly time, and safety of the systems while achieving the same or similar shear strengths, or in some cases greater shear strengths depending on the requirements of the building.

Figure 9A:
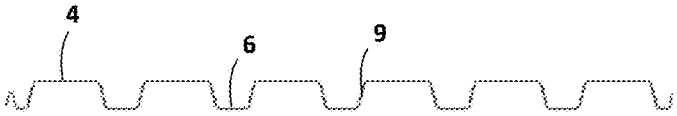
FIG. 9A illustrates a profile view of a decking panel, in accordance with embodiments of the present invention.
Figure 9B:
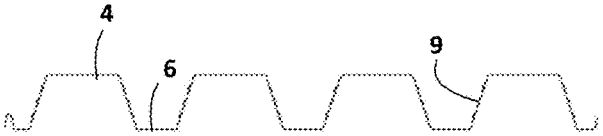
FIG. 9B illustrates a profile view of a decking panel, in accordance with embodiments of the present invention.
Figure 9C:
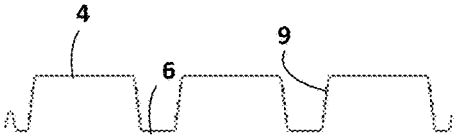
FIG. 9C illustrates a profile view of a decking panel, in accordance with embodiments of the present invention.
Figure 9D:
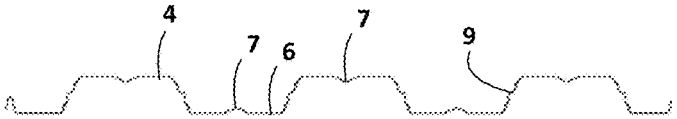
FIG. 9D illustrates a profile view of a decking panel, in accordance with embodiments of the present invention.
Figure 9E:
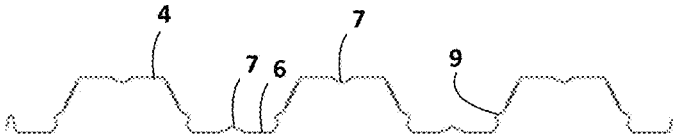
FIG. 9E illustrates a profile view of a decking panel, in accordance with embodiments of the present invention.
Figure 9F:
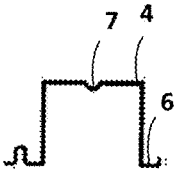
FIG. 9F illustrates a profile view of a portion of a decking panel, in accordance with embodiments of the present invention.
Figure 9G:
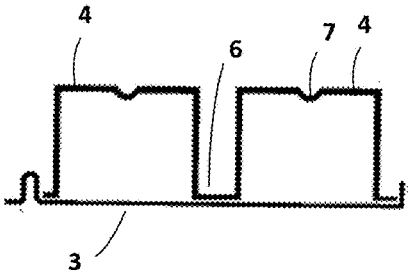
FIG. 9G illustrates a profile view of a portion of a decking panel with a cover, in accordance with embodiments of the present invention.

As previously discussed, any type of decking profile may utilize the four-layer seam 14 in order to improve the shear strength along the seam, and thus, reduce the thickness of the decking material used in a structural decking system and/or reduce the number of couplings used to couple the decking panels together in a structural decking system. FIGS. 9A through 9G illustrate a number of some of the decking profiles that may utilize the four-layer seam of the present invention. FIG. 9A through 9G illustrate different types of profiles that have top flanges 4 and bottom flanges 6, webs 5 as well as cutouts 9 and/or longitudinal ribs 7, which provide increases in the structural strength and stiffness of the steel decking panels 2. The illustrated decking profiles are only some of the decking profiles and it should be understood that any decking panels 2 having any type of decking profile (e.g., triangular, square, trapezoidal, or the like) may utilize the four-layer seams and couplings described herein in order to provide improved shear strength of the decking systems. The profile illustrated in FIG. 9F illustrates a single top flange 4, however it should understood that the profile illustrated in FIG. 9F (as well as the other profiles illustrated and described herein, including but not limited to FIGS. 9A-9G) may have one or more top flanges 4 and one or more bottom flanges 6. Moreover, as illustrated in FIG. 9G, in some embodiments of the invention (and as described in further detail below) the profiles described herein may include one or more covers 3 (otherwise described as a bottom pan).

Figure 10A:
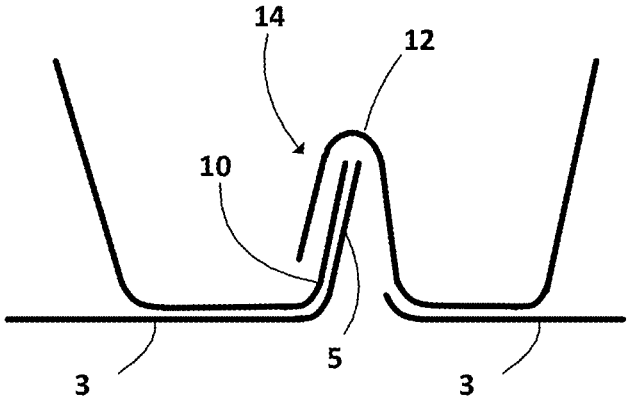
FIG. 10A illustrates a profile view of a first decking single male lip and a cover male lip located within a second decking female lip, in accordance with embodiments of the present invention.
Figure 10B:
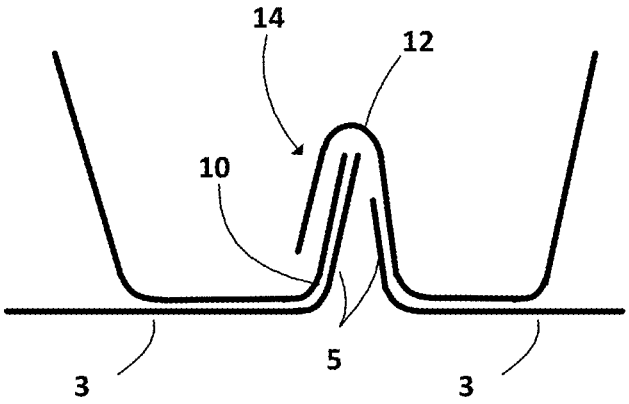
FIG. 10B illustrates a profile view of a first decking single male, a first cover male lip, and a second cover male lip located within a second decking female lip, in accordance with embodiments of the present invention.

FIGS. 10A and 10B illustrate two additional embodiments of the invention, in which cellular decking systems 1000 utilize a seam 14 having at least four-layers. As illustrated in FIG. 10A a decking panel 2 with a single male lip 10 and a decking panel 2 with a female lip 12 may be coupled to one another. The four-layer of the seam 14 may be provided by a cover 3 (otherwise described as a bottom pan) having a male cover lip 5. As illustrated in FIG. 10A the female lip 12 may be placed over both the single male lip 10 and the male cover lip 5 to create the unjoined four-layer seam 14. As was previously described throughout this application, couplings may be created in the unjoined four-layer seam 14, and as such the cellular decking systems 1000 may have improved shear strength that allows for the use of a reduced number of couplings or reduced material thicknesses of the decking panels 2 and/or the covers 3 used in the cellular decking systems 1000. In some embodiments of the invention, along with coupling the male cover lip 5 in the seam 14, the cover 3 may be operatively coupled to the bottom side of the cellular decking system 1000 (e.g., the bottom flanges 6) through spot welds, fasteners, or the like. The cover 3 may also be operatively coupled to joists, walls, headers, or other like structural building members.

With respect to FIG. 10B, in some embodiments of the invention a first male cover lip 5 associated with a first cover 3, a second male cover lip 5 associated with a second cover 3, and a male lip 10 of a first decking panel 2 may be located within the female lip 12 to create a five-layer seam 14. In some embodiments of the invention, all five layers may be used to create the coupling, however, in other embodiments of the invention either the first male cover lip 5 or the second male couple lip 5 may be of a length that allows the cover to be included within the seam 14, but not actually used at the location of the coupling. For example, the seam 14 may include five layers, but only four of the layers are cut using a cutting tool. The fifth layer (e.g., second male cover lip 5) may be long enough to be partially inserted into the seam 14, but may not be long enough to be cut by the cutting tool.

Figure 11:
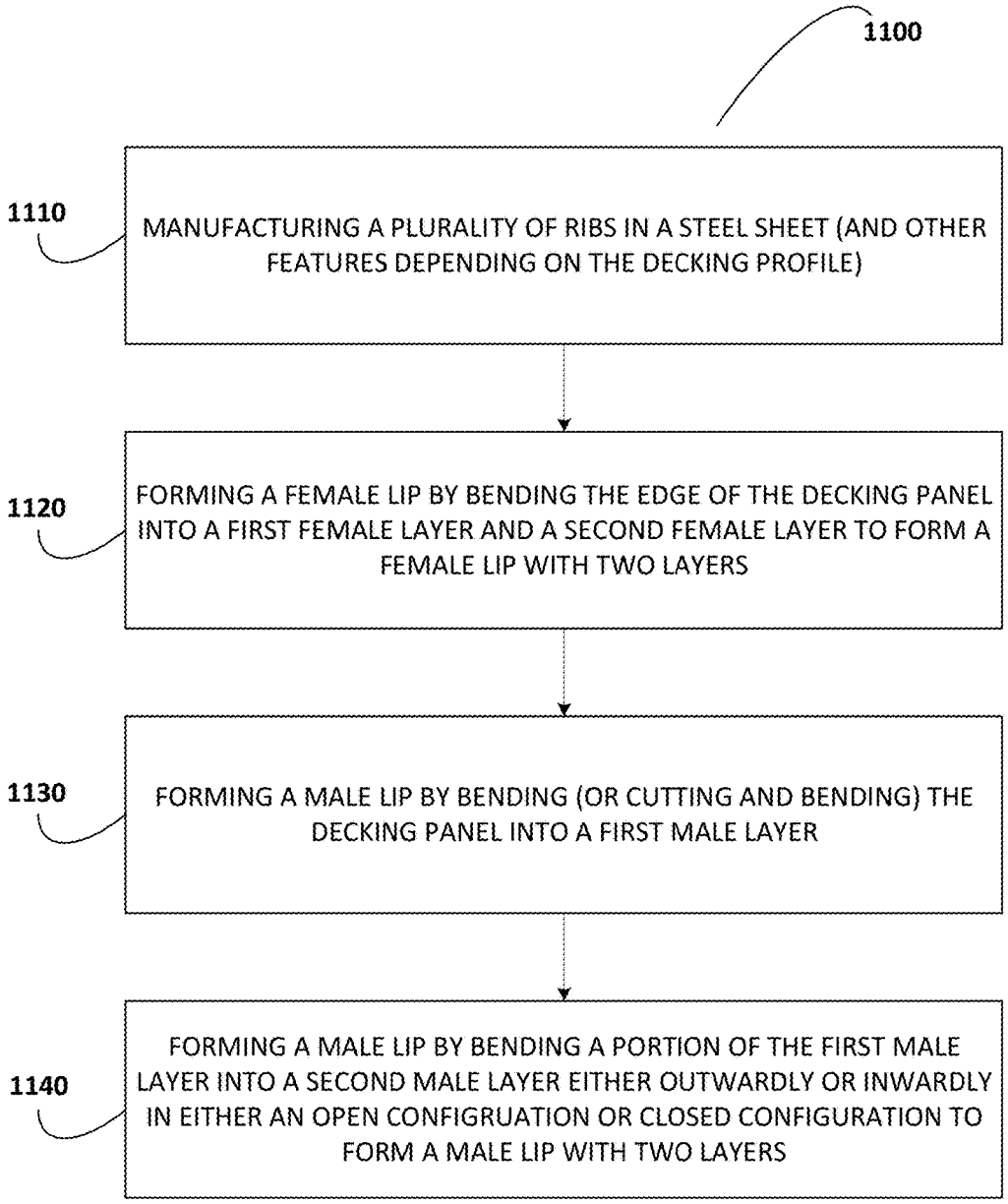
FIG. 11 illustrates a process flow for manufacturing steel decking panels, in accordance with embodiments of the present invention.

FIG. 11 illustrates a general process flow 1100 for manufacturing steel decking panels 2. At block 1110 the process includes forming multiple top flanges 4 and bottom flanges 6 in a steel sheet that has been cut from a coil of steel into the desired length of the structural steel decking. As previously discussed the multiple top flanges 4 and bottom flanges 6 may be formed by roll forming the steel sheet into the desired profile. The height and depth of the top flanges 4 and bottom flanges 6 along with the original width of the steel coil determine the ultimate width of the decking panel. As such, the width of the steel coil used to create the decking panels 2 may be determined based on the desired width of the decking panels 2 and the height and depth of the top flanges 4 and bottom flanges 6.

At block 1120 the process includes forming a female lip 12 along at least one edge 8 of the decking panel 2. The female lip 12 may be formed within the roll forming process by bending (or cutting and bending depending on the size of the female lip) the edge 8 into a first female layer 30 and a second female layer 32. The female lip 12 is configured to fit over an adjacent male lip 10 of an adjacent decking panel 2.

At block 1130 the process includes forming a male lip 10 on at least one edge 8 of the decking panel 2. The male lip 10 may be formed by bending (or cutting and bending depending on the size of the male lip) the edge 8 of the decking panel 2 into a first male layer 20.

At block 1140 the process includes forming a two layer male lip 10 at the edge 8 of the decking panel 2 by bending a portion of the first male layer 20 into a second male layer 22 that is folded back onto the first male layer 20, or by using another like process. The bending may be inwardly or outwardly depending on the desired configuration of the four-layer seam. Moreover, the second male layer 22 is either bent into an open configuration or a closed configuration.

Figure 12:
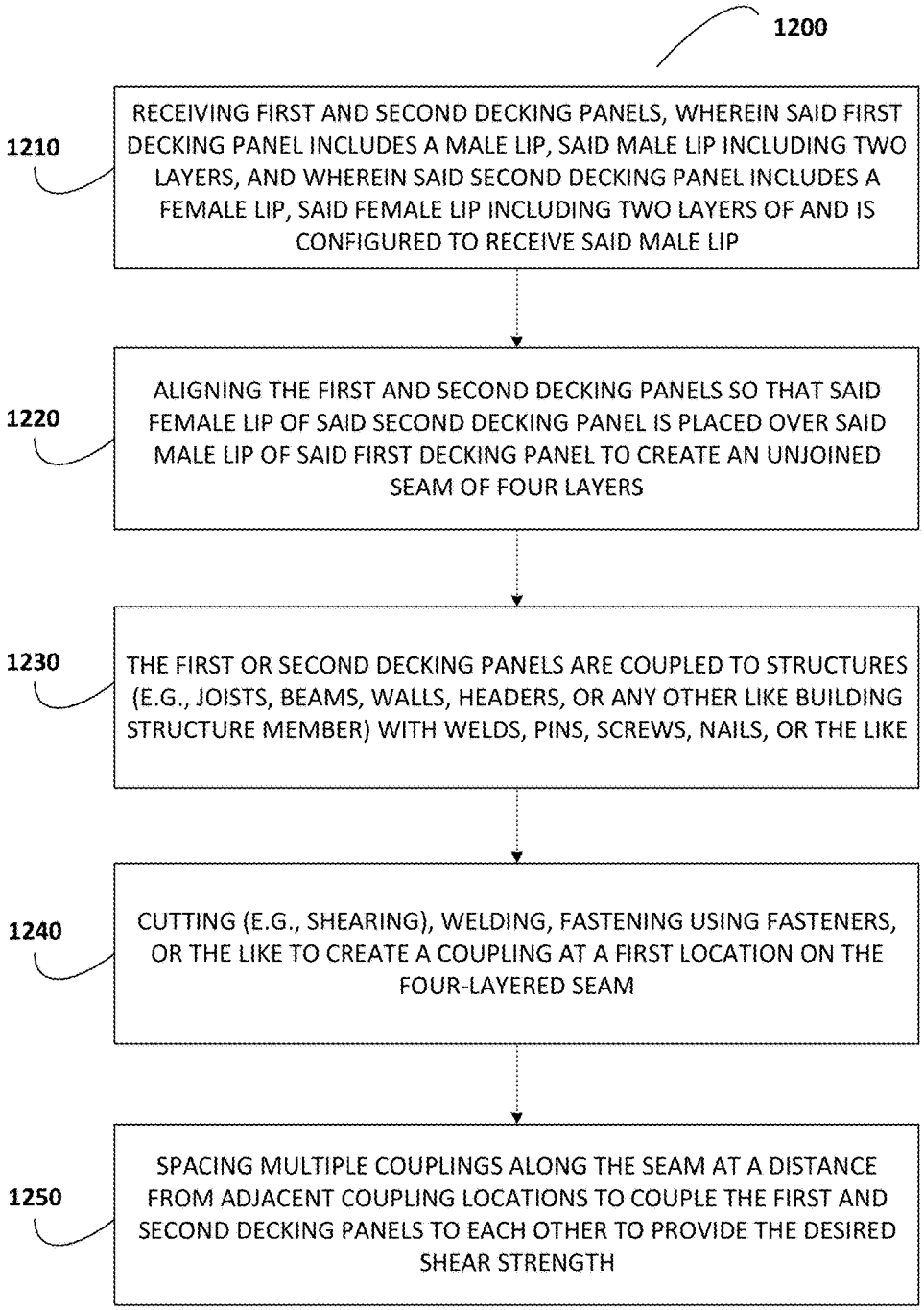
FIG. 12 illustrates a process flow for assembling steel decking panels, in accordance with embodiments of the present invention.

FIG. 12 is a general process flow 1200 for assembling steel decking panels. At block 1210 the process includes receiving first and second decking panels 2, wherein said first decking panel 2 includes at least a male lip 10, and the male lip 10 includes at least two layers of the decking panel 2. The second decking panel 2 includes at least one female lip 12, and the female lip 12 includes at least two layers of the decking panel 2. At block 1220 the process includes aligning the first and second decking panels 2 so that the female lip 12 of the second decking panel 2 is placed over the male lip 10 of the first decking panel 2 to create an unjoined seam 14 of four layers of steel. In other embodiments of the invention, as previously discussed the female lip 12 may have three layers and the male lip 10 may have only one layer. In other embodiments the female lip 12 may have two layers, the male lip 10 may have a single layer, and one or more covers 3 may have one or more male cover lips 3 that are included within the seam 14 to form the seam with four or more layers. It should be understood that the method described in FIG. 12 may relate to any of the profiles or seams 14 described herein.

Block 1230 illustrates that the first and/or second decking panels 2 are operatively coupled to the building structure, such as but not limited through couplings with the joists, beams, walls, headers, or any other like building structure member. The couplings between the decking panels 2 and the building structure may be made through the use of welds, fasteners, or other like couplings. In some embodiments of the invention, the first and/or second decking panels 2 may be coupled to the building structure before, during, or after the unjoined seam 14 is created between adjacent panels 2, or before, during, or after the couplings are formed in the seam 14 (e.g., in the four-layer seam 14).

At block 1240 the process includes creating a coupling (e.g., joint, connection, attachment, or the like) at a first location on the seam 14. As previously discussed, the coupling may be created by shearing substantially through the four-layer seam 14 (or other seam with more than four-layers) at the first location. In other embodiments, the coupling may be created by welding (e.g., top-seam weld or side-seam weld) the female lip 12 to the male lip 10 to create the coupled seam 14. At block 1250 the process includes creating couplings at one or more additional locations along the seam 14. As with the coupling at the first location the couplings may be created by cutting (e.g., shearing, punching, or the like), welding, fastening fasteners, or through other like means. In some embodiments of the invention, the spacing of the couplings in the seam 14 are positioned to create the desired shear strength in the assembled structural decking system based at least in part on the requirements of the building, the type of couplings used, the thickness of the panels 2, the longitudinal ribs 7 in the panels 2, cutouts 9 in the panels 2, or the like.

As such, in one example a first decking panel with a male lip 10 is secured to the building structure through one or more couplings, the second decking panel 2 with a female lip 12 is placed over the male lip 10, and the second decking panel is secured to the building structure through one or more couplings. Couplings are also formed in the seam 14 created by the first decking panel 2 and the second decking panel 2 in order to couple the decking panels to each other. Other decking panels 2 are added, and the couplings are made until the decking system is complete.

In still other embodiments of the invention when the female lip 12 is placed over the male lip 10, as illustrated in FIGS. 4A to 4D the seam is not joined, and as such one panel may be lifted off of an adjacent panel before they are coupled together. However, in some embodiments of the invention the female lip 12 or the male lip 10 may have a curved end or other feature that allows the male lip to clip into an edge of the female lip, or vice versa. In these embodiments, the female lip 12 and the male lip 10 may be partially coupled to prevent a decking profile from lifting off an adjacent decking profile before the couplings are made. Moreover, while the decking profiles may be partially coupled in these embodiments the improvements to the shear strength are not realized without creating the couplings along the seam because the panels could still move laterally with respect to each other without the couplings.

FIGS. 13A-13L illustrate a process flow for creating a two-layered male lip 10 that is in the closed configuration and is folded inwardly, in accordance with one embodiment of the present invention. FIGS. 13A-13L illustrate the process in the form of a cross-sectional view of a portion of a profile and edge 8 of a panel 2 and at least a portion of the rollers 62, 64 that may be used to create the two-layered male lip 10. FIGS. 13A-13L illustrate creating the male lip 10 in the decking panel utilizing a roll-forming process. A roll-forming process shapes sheets of metal into the desired shapes through one or more rolling stages using one or more sets 60 opposing rollers 62, 64 (e.g., dies, or the like) that provide the desired shape. As such, in order to create the male lip 10 a decking profile, the top flanges 4 and bottom flanges 6 may first be creating by rolling a sheet into the desired profile. As illustrated by the profile view 1302 in FIG. 13A, a substantially flat partial bottom flange 6 is created at the panel edge 8 during or after the forming of the profile of the top flanges 4 and bottom flanges 6 of the panel 2.

Figure 13A:
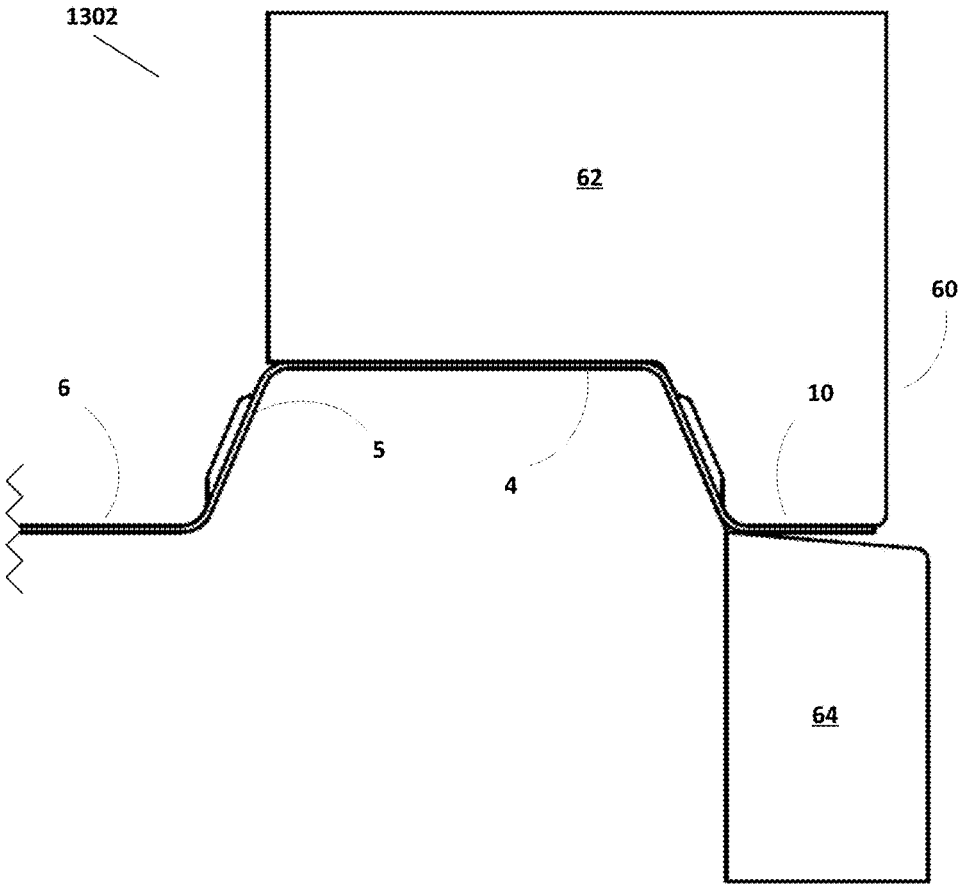
FIG. 13A illustrates a portion of a process flow for creating a two-layered male lip, in accordance with embodiments of the present invention.
Figure 13B:
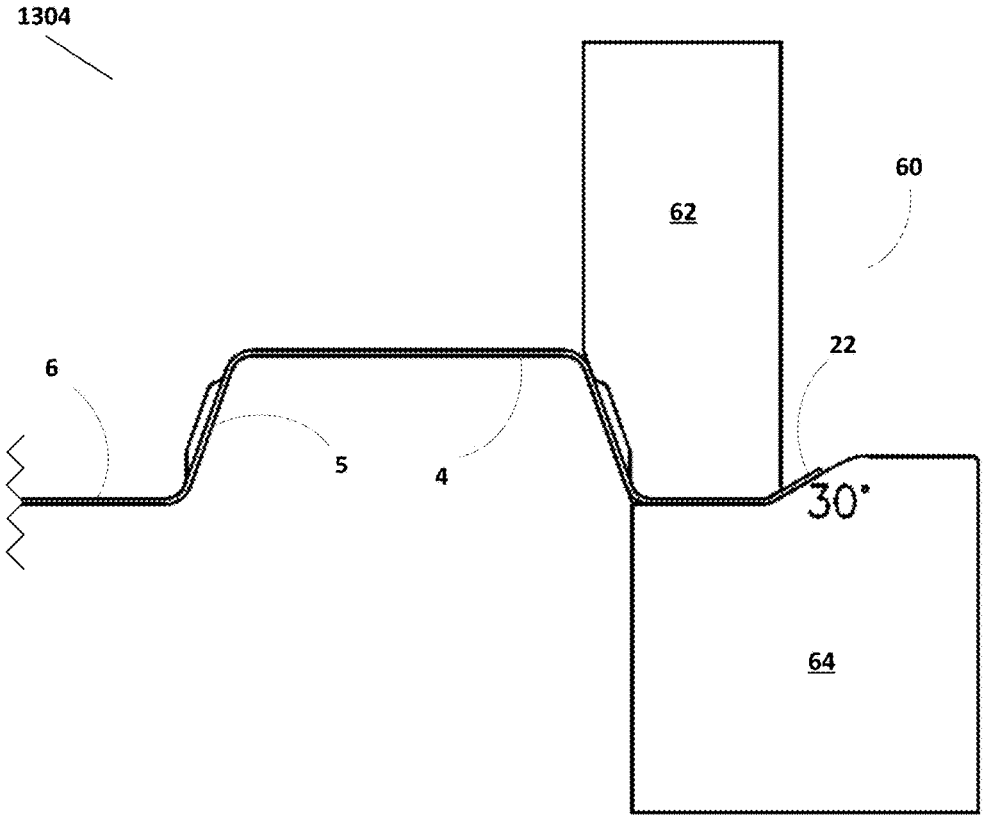
FIG. 13B illustrates a portion of a process flow for creating a two-layered male lip, in accordance with embodiments of the present invention.

As illustrated by the profile view 1304 in FIG. 13B, the second male lip layer 22 may begin to be formed by bending a portion of the panel edge 8 at an angle of thirty (30) degrees from the horizontal orientation of the decking panel 2. In other embodiments of the invention the portion of the panel may be bent into an angle greater or less than thirty (30) degrees, or may be bent into an angle that ranges from five (5) to eighty-nine (89) degrees.

Figure 13C:
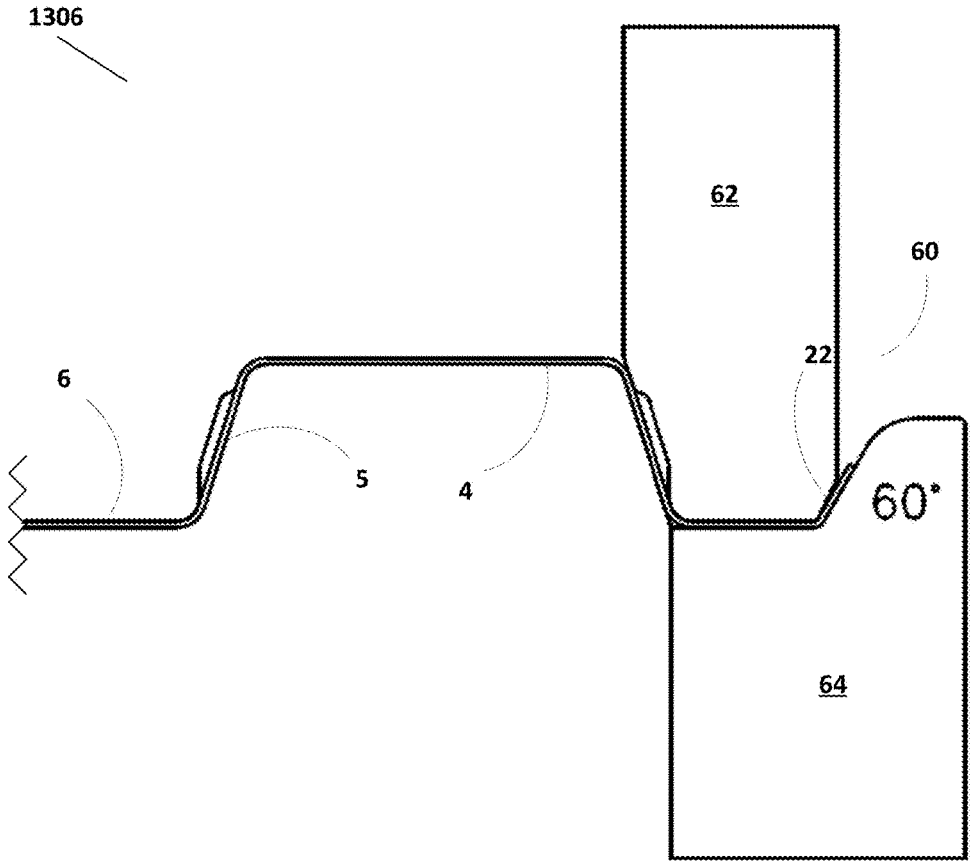
FIG. 13C illustrates a portion of a process flow for creating a two-layered male lip, in accordance with embodiments of the present invention.

As illustrated by the profile view 1306 in FIG. 13C, the second male lip layer 22 may be further formed by further bending the second male lip layer 22 into an angle of 60 degrees from the horizontal orientation of the decking panel 2. In other embodiments of the invention the second male lip layer 22 may be bent into an angle that is greater or less than 60 degrees, or may be bent into an angle that ranges from 5 to 89 degrees.

Figure 13D:
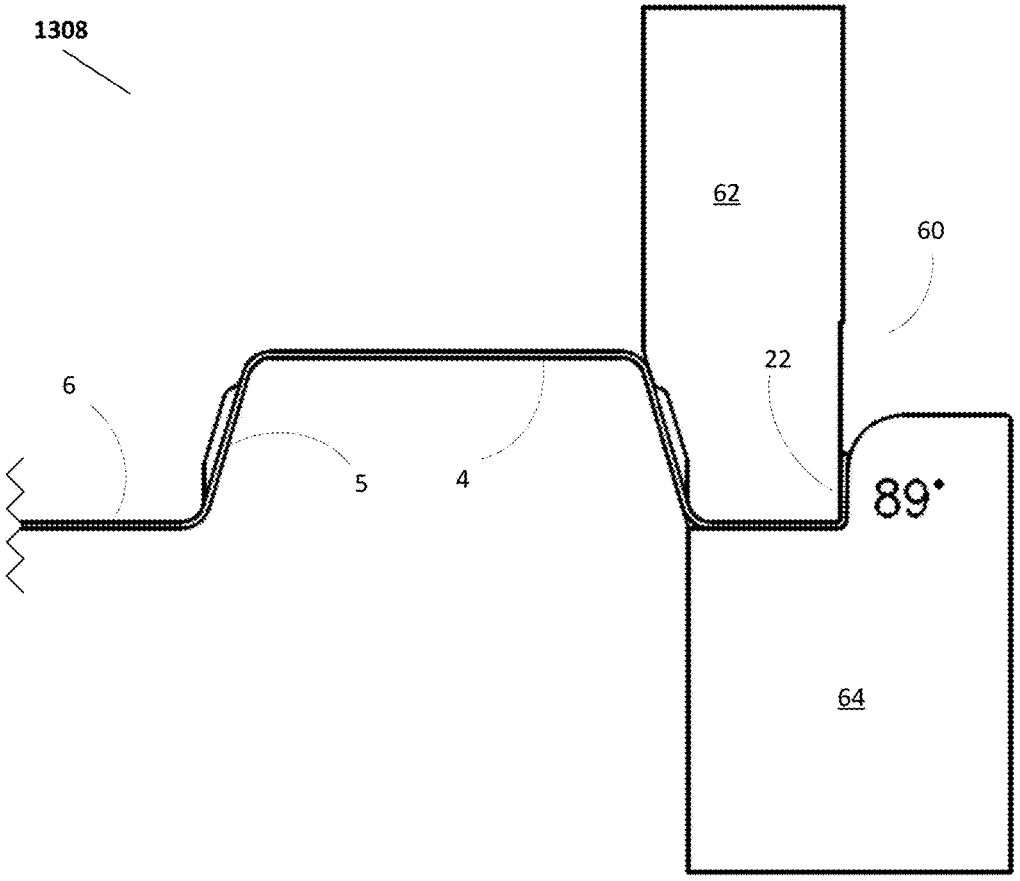
FIG. 13D illustrates a portion of a process flow for creating a two-layered male lip, in accordance with embodiments of the present invention.

As illustrated by the profile view 1308 in FIG. 13D, the second male lip layer 22 may be further formed by further bending the second male lip layer 22 into angle of approximately eighty-nine (89) degrees from the horizontal orientation of the decking panel 2. In other embodiments of the invention the second male lip layer 22 may be bent into an angle that is greater or less than eighty-nine (89) degrees, or may be bent into an angle that ranges from five (5) to eighty-nine (89) degrees.

Figure 13E:
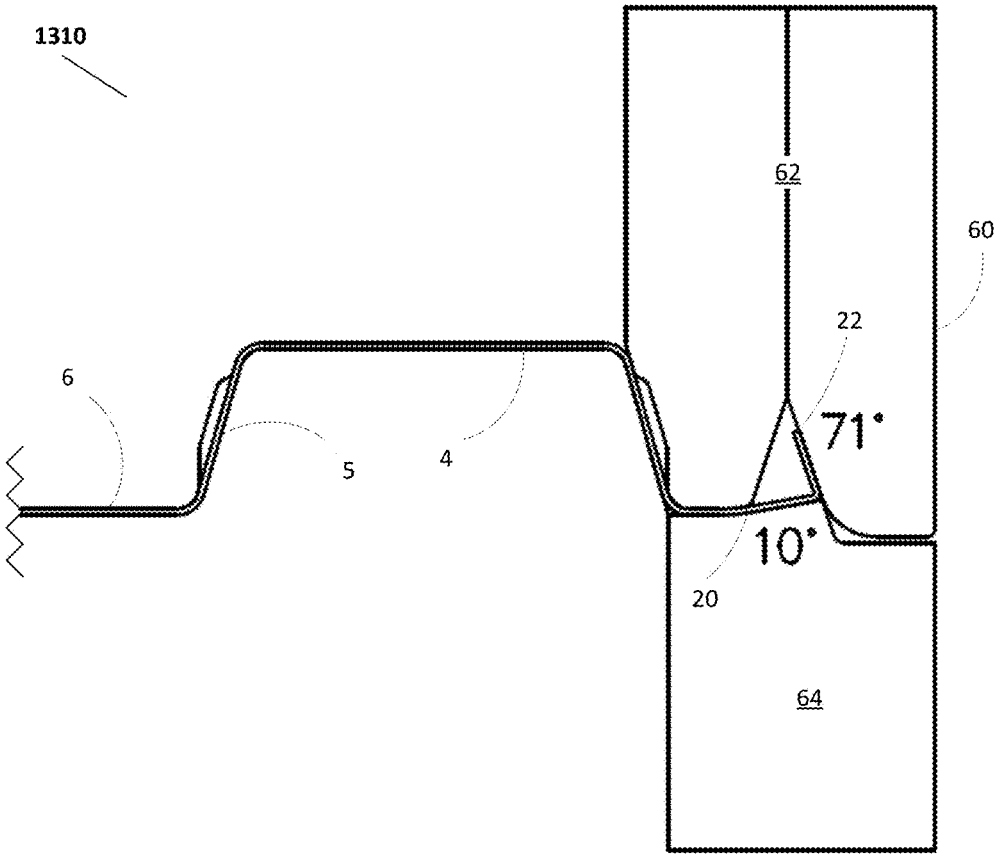
FIG. 13E illustrates a portion of a process flow for creating a two-layered male lip, in accordance with embodiments of the present invention.

As illustrated by the profile view 1310 of FIG. 13E, the first male lip layer 20 may then be created by bending another portion of the panel edge 8 at an angle of ten (10) degrees from the horizontal orientation of the decking panel 2. In other embodiments of the invention the portion of the panel edge 8 of the first male lip layer 20 may be bent into an angle that is greater or less than ten (10) degrees, or may be bent into angle that ranges from five (5) to eighty-nine (89) degrees. Moreover, as illustrated by the profile view 1310, the second male lip layer 20 may be bent into an angle of seventy-one (71) degrees (e.g., one-hundred and nine (109) degrees in the original orientation) with respect to the horizontal orientation of the decking panel 2. This angle of the second male lip layer 20 may be greater or less than seventy (71) degrees or may range from ninety-one (91)

degrees to negative ten (−10) degrees (e.g., eighty-nine (89) degrees to one-hundred ninety (190) degrees from the original orientation).

Figure 13F:
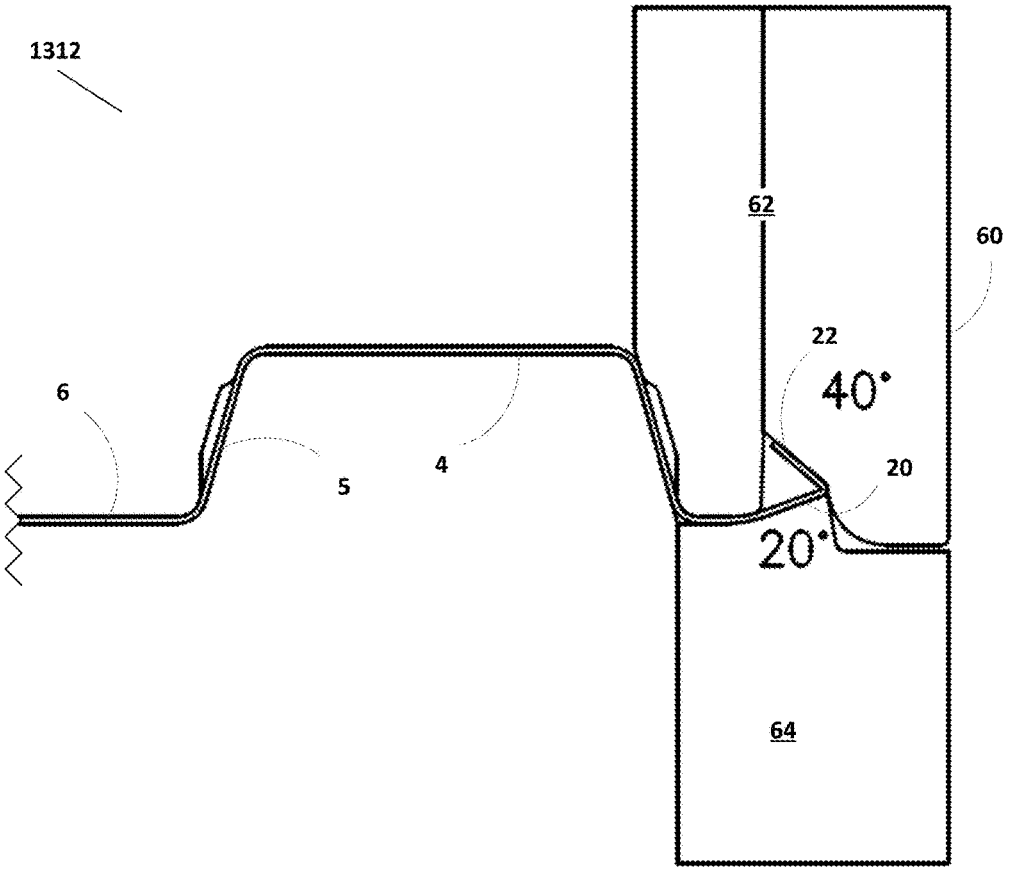
FIG. 13F illustrates a portion of a process flow for creating a two-layered male lip, in accordance with embodiments of the present invention.

As illustrated by the profile view 1312 of FIG. 13F, the first male lip layer 20 may be further bent into an angle of twenty (20) degrees from the horizontal orientation of the decking panel 2. In other embodiments of the invention, the first male lip layer 20 may be bent into an angle that is greater or less than twenty (20) degrees, or may be bent into an angle that ranges from ten (10) to eighty-nine (89) degrees. Moreover, as illustrated by the profile view 1312 the second male lip layer 20 may be bent into an angle of forty (40) degrees with respect to the horizontal orientation of the decking panel 2. This angle of the second male lip layer 20 may be greater or less than forty (40) degrees or may range from seventy-one (71) degrees to negative twenty (−20) degrees (e.g., one-hundred nine (109) degrees to two-hundred (200) degrees from the original orientation).

Figure 13G:
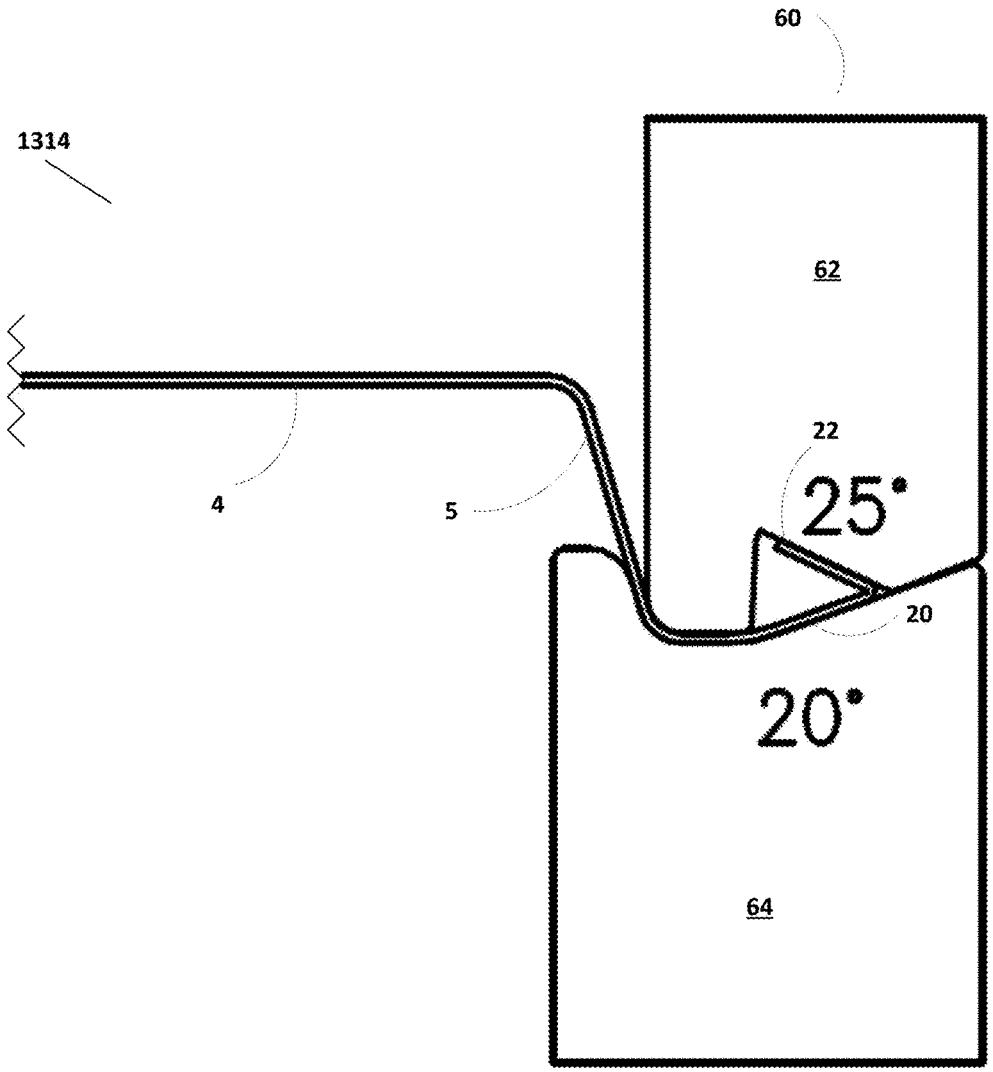
FIG. 13G illustrates a portion of a process flow for creating a two-layered male lip, in accordance with embodiments of the present invention.

As illustrated by the profile view 1314 of FIG. 13G, the second male lip layer 20 may be bent into an angle of twenty-five (25) degrees with respect to the horizontal orientation of the decking panel 2. This angle of the second male lip layer 20 may be greater or less than twenty-five (25) degrees or may range from forty (40) degrees to negative twenty (−20) degrees (e.g., one-hundred forty (140) degrees to two-hundred (200) degrees from the original orientation).

Figure 13H:
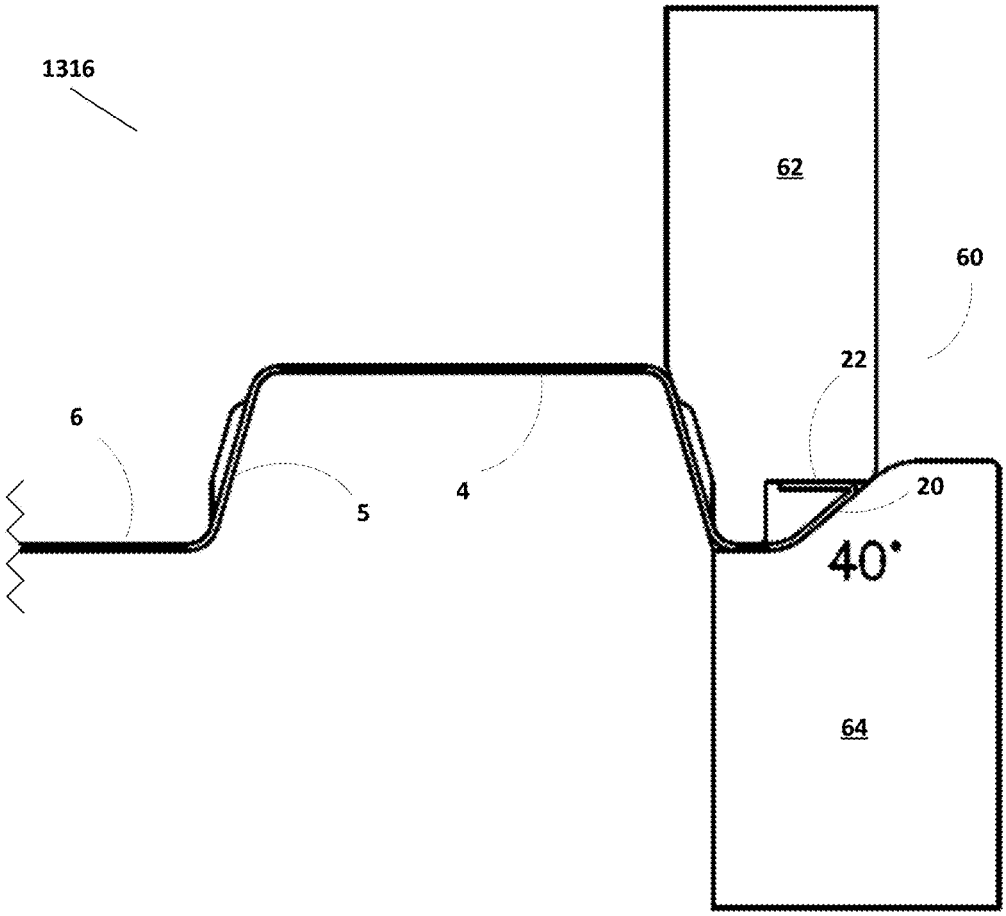
FIG. 13H illustrates a portion of a process flow for creating a two-layered male lip, in accordance with embodiments of the present invention.

As illustrated by the profile view 1316 of FIG. 13H, the first male lip layer 20 may be further bent into an angle of forty (40) degrees from the horizontal orientation of the decking panel 2. In other embodiments of the invention, the first male lip layer 20 may be bent into an angle that is greater or less than forty (40) degrees, or may be bent into an angle that ranges from twenty (20) to eighty-nine (89) degrees. Moreover, as illustrated by the profile view 1316 the second male lip layer 20 may be bent into a parallel position with respect to the horizontal orientation of the decking panel 2. This angle of the second male lip layer 20 may be greater or less than the parallel position, or may range from twenty-five (25) degrees to negative forty (−40) degrees (e.g., one-hundred fifty-five (155) degrees to two-hundred twenty (220) degrees from the original orientation).

Figure 13I:
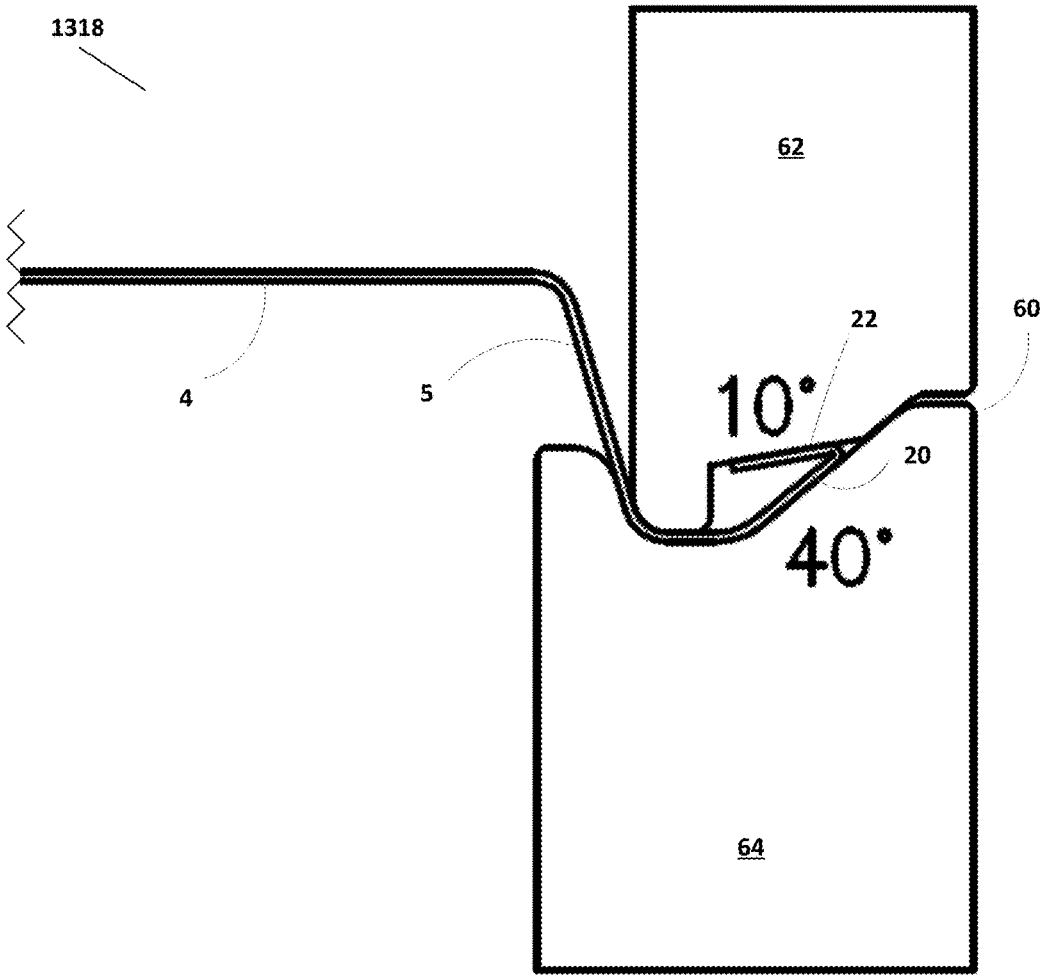
FIG. 13I illustrates a portion of a process flow for creating a two-layered male lip, in accordance with embodiments of the present invention.

As illustrated by the profile view 1318 of FIG. 13I, the second male lip layer 20 may be bent into an angle of negative ten (−10) degrees (or ten (10) degrees) with respect to the horizontal orientation of the decking panel 2. This angle of the second male lip layer 20 may be greater or less than ten (10) degrees or may range from zero (0) degree to negative forty (−40) degrees (e.g., one-hundred eighty (180) degrees to two-hundred twenty (220) degrees from the original orientation).

Figure 13J:
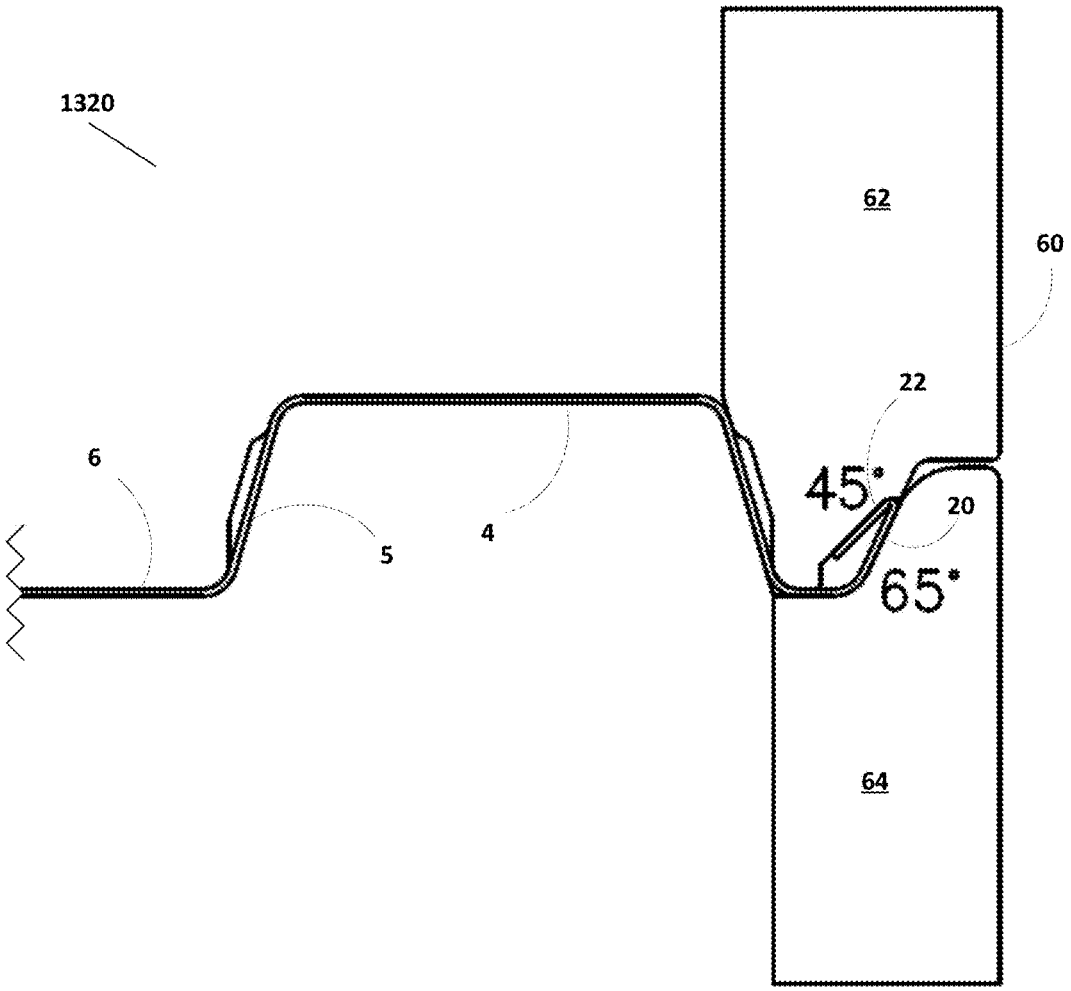
FIG. 13J illustrates a portion of a process flow for creating a two-layered male lip, in accordance with embodiments of the present invention.

As illustrated by the profile view 1320 of FIG. 13J, the first male lip layer 20 may be further bent into an angle of sixty-five (65) degrees from the horizontal orientation of the decking panel 2. In other embodiments of the invention the first male lip layer 20 may be bent into an angle that is greater or less than sixty-five (65) degrees, or may be bent into an angle that ranges from forty (40) to eighty-nine (89) degrees. Moreover, as illustrated by the profile view 1320 the second male lip layer 20 may be bent into an angle of negative forty-five (−45) degrees (e.g., forty-five (45) degrees) with respect to the horizontal orientation of the decking panel 2. This angle of the second male lip layer 20 may be greater or less than forty-five (45) degrees or may range from negative ten (−10) degrees to negative sixty-five (−65) degrees (e.g., one-hundred ninety (190) degrees to two-hundred forty-five (245) degrees from the original orientation).

Figure 13K:
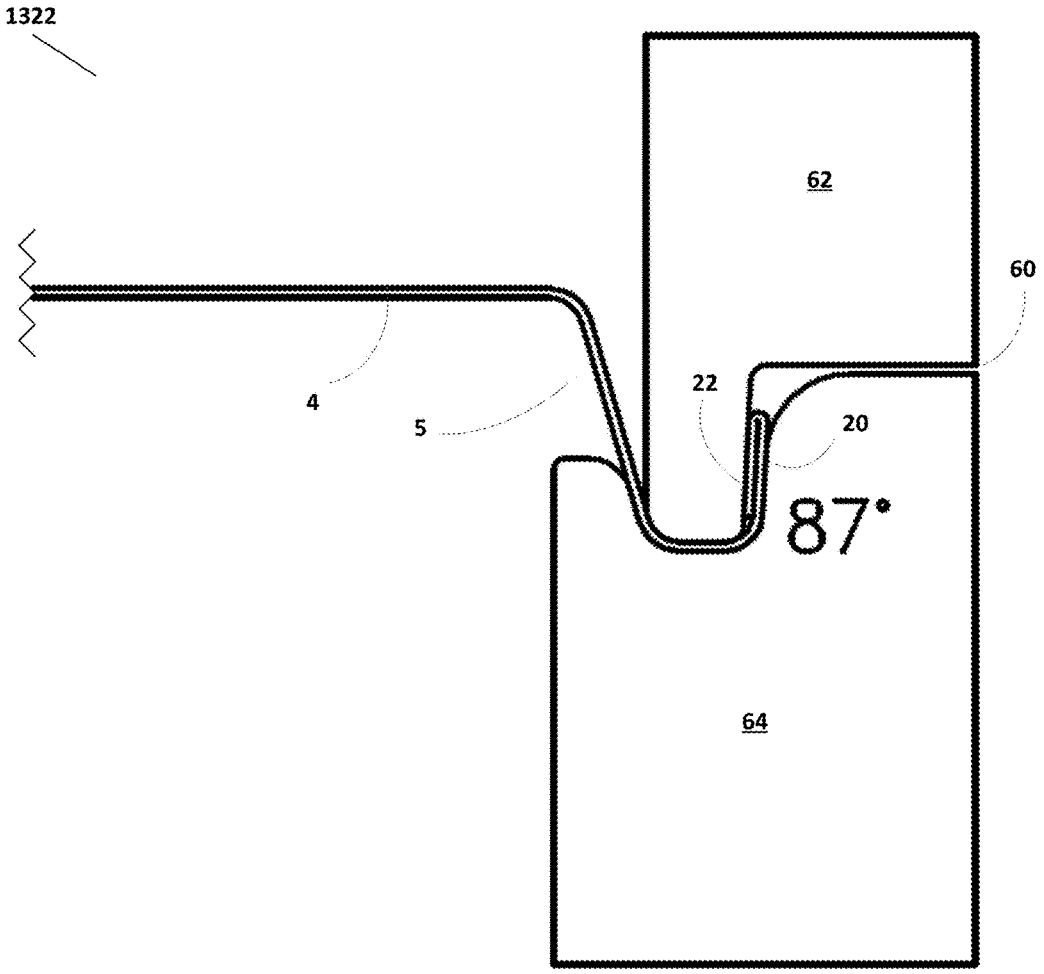
FIG. 13K illustrates a portion of a process flow for creating a two-layered male lip, in accordance with embodiments of the present invention.

As illustrated by the profile view 1322 of FIG. 13K, the first male lip layer 20 and the second male lip layer 22 may be bent together in a closed configuration and bent together at an angle of eighty-seven (87) degrees from the horizontal orientation of the decking panel 2. In other embodiments of the invention the angle of the first male lip layer 20 and second male lip layer 22 may be greater or less than eighty-seven (87) degrees, or may be bent into angle that ranges from sixty-five (65) to one-hundred thirty-five (135) degrees from the horizontal orientation of the decking panel 2.

Figure 13L:
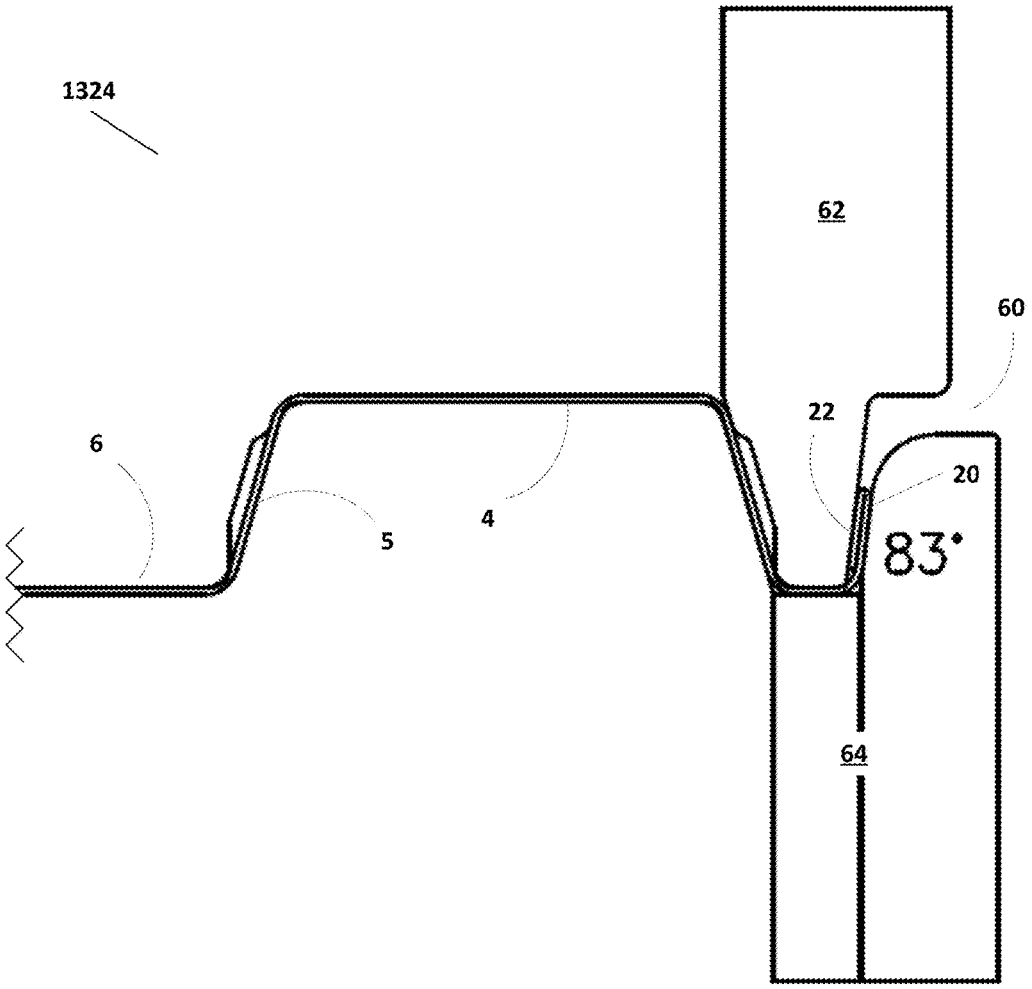
FIG. 13L illustrates a portion of a process flow for creating a two-layered male lip, in accordance with embodiments of the present invention.

As illustrated by the profile view 1324 of FIG. 13L, the first male lip layer 20 and the second male lip layer 22 may be bent to an angle of eighty-three (83) degrees in order to finalize the male lip 10. In other embodiments of the invention, the male lip 10 may be bent into an angle that is less than or greater than eighty-three (83) degrees, or may be bent into an angle that ranges from sixty (60) to one-hundred twenty (120) degrees.

The process illustrated in FIGS. 13A-13L is related to forming a closed inwardly folded male lip 10. It should be understood that in other embodiments of the invention, the inwardly folded may lip may be folded in an inwardly open configuration, in an outwardly open configuration, or in an outwardly closed configuration. As such, the bends of the angles, the direction of the bends, and the rollers 62, 64 used to make the bends described above may be different for these other types of male lip configurations, but the concept of creating the male lip 10 using the multiple bending steps of a roll-forming process is the same. Moreover, the bends of the angles and the direction of the bends described for FIGS. 13A-13L may be different as well. For example, the bend angles or ranges of bend angles may fall within the stated ranges, fall outside of the ranges, or overlap the stated ranges. Moreover, more or less bending steps may be needed to achieve the desired lips on the panels 2.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A method of assembling a structural roof or wall decking system for providing diaphragm strength to a building, the method comprising:

assembling a first structural decking panel to at least one of two or more support members, wherein the first structural decking panel comprises:

a plurality of uniform first decking panel flutes, wherein each of the first decking panel flutes comprise a first top flange, a bottom flange, and webs; and at least one edge comprising a male lip formed in the bottom flange of one of the plurality of uniform flutes, wherein the male lip comprises:

a first male layer;

a second male layer;

wherein the second male layer is folded over the first male layer in a closed configuration or an open configuration to form the male lip with two layers; and assembling a second structural decking panel to the first structural decking panel by placing a female lip of the second structural decking panel over the male lip and securing the second structural decking panel to at least one of the two or more support members, wherein placing the female lip over the male lip occurs without having to rotate the structural decking panels and without having to bend or deform the female lip or the male lip during placement, and wherein the second structural decking panel comprises:

a plurality of uniform second decking panel flutes, wherein each of the second decking panel flutes comprise a top flange, a bottom flange, and webs; and at least one edge comprising a female lip formed in the bottom flange of one of the plurality of uniform flutes;

wherein assembling the female lip of the second structural decking panel over the male lip of the first structural decking panel creates a seam with four or more layers and wherein the male lip and the female lip have tolerances to allow for alignment of the female lip over the male lip along the length of the panels with spaces between the male lip and the female lip;

wherein the male lip and the female lip are generally perpendicular to a plane formed from the first structural decking panel and the second structural decking panel, and extends from the bottom flange of the first structural decking panel and the bottom flange of the second structural decking panel; and forming one or more couplings in the male lip and the female lip of a portion of the seam with four or more layers in order to couple the first structural decking panel to the second structural decking panel, and wherein the one or more couplings provide shear strength in the seam.

2. The method of claim 1, wherein the female lip comprises:

a first female layer;

a second female layer; and wherein the second female layer is folded with respect to the first female layer to form a v-shaped or u-shaped female lip with two layers.

3. The method of claim 1, wherein forming the one or more couplings comprises shearing and deforming the male layer and the female layer.

4. The method of claim 1 wherein the first structural decking panel and the second structural decking panel are formed from metal sheets with thicknesses of 22 gage steel or greater thicknesses, and wherein the first structural decking panel and second structural decking panel are manufactured by:

forming the plurality of uniform first decking panel flutes in the first structural decking panel and forming the plurality of uniform second decking panel flutes in the second structural decking panel from the metal sheet in a flute roll forming process using flute rollers; and forming the male lip in the first structural decking panel and forming the female lip in the second structural decking panel in a lip roll forming process using lip rollers.

5. The method of claim 1, wherein the one or more couplings are tabs, top-seam welds or side-seam welds in the seam; and wherein the top-seam welds or side-seam welds are formed through the four or more layers of the portion of the seam and wherein the tabs are formed in the portion of the seam by shearing through the straight surfaces in the four or more layers.

6. The method of claim 1, wherein the first male layer and the second male layer are straight sections without additional bends.

* * * * *